US005426496A

United States Patent [19]

Koike et al.

[11] Patent Number: 5,426,496

[45] Date of Patent: Jun. 20, 1995

[54] PRINTING APPARATUS

[75] Inventors: Shuji Koike; Jun Kodama; Motomichi Shibano; Nobuyuki Tanaka; Sachio Sasaki; Kunihiko Sato; Tomohisa Mikami; Masatoshi Kimura, all of Kawasaki, Japan

[73] Assignee: Fujitsu Limied, Kawasaki, Japan

[21] Appl. No.: 120,350

[22] Filed: Sep. 14, 1993

[30] Foreign Application Priority Data

Sep. 16, 1992 [JP] Japan ..... 4-246296
May 14, 1993 [JP] Japan ..... 5-136906

[51] Int. Cl.[6] ..... G03G 15/00
[52] U.S. Cl. ..... 355/309; 355/308
[58] Field of Search ..... 355/309, 308; 346/761, 346/160, 153.1

[56] References Cited

U.S. PATENT DOCUMENTS 4,727,387 2/1988 Israely ..... 346/160
5,038,228 8/1991 Takada ..... 355/308 X
5,065,197 11/1991 Mitsuyama ..... 355/309

*Primary Examiner*—R. L. Moses
*Attorney, Agent, or Firm*—Staas & Halsey

[57] ABSTRACT

Disclosed is a slim printing apparatus which employs a latent image forming method, such as electrophotographing method, and needs an apparatus-occupying area. This printing apparatus comprises a hopper for retaining sheets; a feeding path defined on that surface of the apparatus which is opposite to that surface of the apparatus where the hopper is disposed for conveyance of sheets; a feeding mechanism for feeding a sheet from the hopper onto the feeding path; an endless rotary latent image carrier provided between the hopper and the feeding path; an image forming unit, provided between the hopper and the feeding path, for forming a toner image on the latent image carrier; a transfer unit for transferring the toner image on the latent image carrier onto the sheet conveyed along the feeding path; and a fixing unit for fixing the toner image on the sheet.

70 Claims, 21 Drawing Sheets

PRINTING APPARATUS

BACKGROUND OF THE INVENTION

1. Field of the Invention

The present invention relates to a printing apparatus which forms a toner image on a latent image carrier, and transfers the toner image on a sheet, yielding a printout, and, more particularly, to a compact printing apparatus.

2. Description of the Related Art

Due to the recent trend to the downsizing and personal usage of computers, it is also desirable that printing apparatuses, which are used as output devices for personal computers or the like, be designed compact. Particularly, there is a demand for A4-size and slim printing apparatuses to match the reduced sizes of personal computers, word processors, etc. Such printing apparatuses are accomplished in wire dot printers and thermal transfer printers whose printing process is easy.

As those wire dot printers, etc. have a low printing resolution, there is a demand for compact and slim electrophotographic recording type printers which can provide high printing resolution.

FIG. 1 is an explanatory diagram of a conventional electrophotographic printer. In the electrophotographic printer, as shown in FIG. 1, a pre-charger 91 for uniformly charging the surface of the photosensitive drum 90, a laser optical system 92 for performing image exposure, a developing unit 93, such as a two-component developing unit, magnetic one-component developing unit or non-magnetic one-component developing unit, a transfer roller 94 for transferring a toner image on the photosensitive drum 90 onto a paper, a cleaner 95 such as a fur brush cleaner or a blade cleaner, and a deelectrifying lamp 96 are disposed around a photosensitive drum 90, such as an organic photosensitive body, Se photosensitive body or a-Si photosensitive body. A thermal fixing unit 97 for fixing the toner image on the sheet with heat or pressure is further provided on a sheet-conveying passage where the sheet is conveyed.

The image forming operation is performed in the following manner. First, the surface of the photosensitive drum 90 is uniformly charged by the pre-charger 91 and then the charged surface is exposed with an optical image corresponding to a target image by the laser optical system 92, thus forming an electrostatic latent image corresponding to the target image on the photosensitive drum 90. Then, charged toners are supplied to the photosensitive drum 90 to develop the electrostatic latent image on the drum 90 in the developing unit 93. The transfer roller 94 as a transfer unit, is disposed in the vicinity of the photosensitive drum 90 with the sheet in between, and electrostatically transfers the toner image on the photosensitive drum 90 onto the sheet. While the sheet carrying this toner image passes through the thermal fixing unit 97, the toner image is fixed on the sheet with heat and pressure, completing the printing. The sheet is then discharged. The top surface of the photosensitive drum 90 after the toner image transfer on the sheet is cleaned with the cleaner 95 to remove the residual toners on the drum 90. Then, the residual charges on the photosensitive drum 90 are removed by the deelectrifying lamp 96 so that the drum 90 returns to the initial state to be ready for another printing operation.

As it is inconvenient to set sheets one by one in such a printing apparatus, it is necessary to provide a hopper retaining a number of sheets. FIGS. 2A through 2D illustrate known arrangements of an electrophotographic printer equipped with conventional hoppers. The first type, as shown in FIG. 2A, has a hopper 8 located at the bottom of the printer and a feeding path for feeding sheets upward from the hopper 8. The print process unit is provided above the hopper 8. A toner image on the photosensitive drum 90 of the print process unit is transferred on a sheet, fed out through the vertical feeding path, and is then fixed by the fixing unit 97 before the sheet is discharged upward of the printer.

The second type has a straight sheet feeding path and the hopper 8 and the print process unit provided on a straight line, as shown in FIG. 2B. A toner image on the photosensitive drum 90 is transferred on a sheet, fed out from the hopper 8 located on the left-hand side in the diagram. The toner image is then fixed by the fixing unit 97 and the sheet is discharged rightward in the diagram.

The third type has an S-shaped sheet feeding path along which a sheet fed out from the hopper located at the bottom of the printer is conveyed, as shown in FIG. 2C. While the sheet is conveyed, a toner image on the photosensitive drum 90 of the print process unit is transferred on the sheet and is then fixed by the fixing unit 97. The sheet is then discharged upward.

As shown in FIG. 2D, the fourth type is similar to the second type shown in FIG. 2B with a difference lying in that the sheet discharging direction is upward in the fourth type. Also known is a modification of the structure shown in FIG. 2B in which printed sheets are returned to the hopper 8, allowing the top of the hopper 8 to be used as a stacker. Such a modification is disclosed in, for example, Japanese Unexamined Patent Publication Nos. 28395/83 and 171181/85.

As the conventional structure shown in FIGS. 2A and 2C have the hopper 8 disposed inside the printer, the printers need a small occupying area. But those printers stand tall and cannot be designed slim. While the conventional structures shown in FIGS. 2B and 2D stand short and are thus slim, they need a larger occupying area.

SUMMARY OF THE INVENTION

It is therefore a primary object of the present invention to provide a printing apparatus which is designed slim as well as needing a small occupying area.

It is another object of this invention to provide a printing apparatus which is designed slim as well as needing a small occupying area even with the use of a printing mechanism for forming a toner image.

It is a further object of this invention to provide a printing apparatus which is designed to need a reduced occupying area even with the use of a printing mechanism for forming a toner image.

To achieve the foregoing and other objects and in accordance with the purpose of the present invention, according to one aspect of this invention, a printing apparatus comprising a hopper for retaining sheets; a feeding path defined on that surface of the apparatus which is opposite to that surface of the apparatus where the hopper is disposed for conveyance of sheets; a feeding mechanism for feeding a sheet from the hopper onto the feeding path; an endless rotary latent image carrier provided between the hopper and the feeding path; an image forming unit, provided between the hopper and the feeding path, for forming a toner image on the latent image carrier; a transfer unit for transferring the toner image on the latent image carrier onto the sheet conveyed along the feeding path; and a fixing unit for fixing the toner image on the sheet.

According to this structure, the feeding path has a U shape. The feeding path is provided on the opposite surfaces of the hopper, and the feeding mechanism is provided to feed sheets onto the feeding path from the hopper. A print process unit (the latent image carrier and the image forming unit) is disposed between the hopper and the feeding path, so that the print process unit transfers a toner image on a sheet in the feeding path. This design can reduce the area this apparatus occupy to the size of a sheet, and can make the apparatus as tall as the print process unit. It is therefore possible to accomplish a compact and slim printer.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Figure 3:
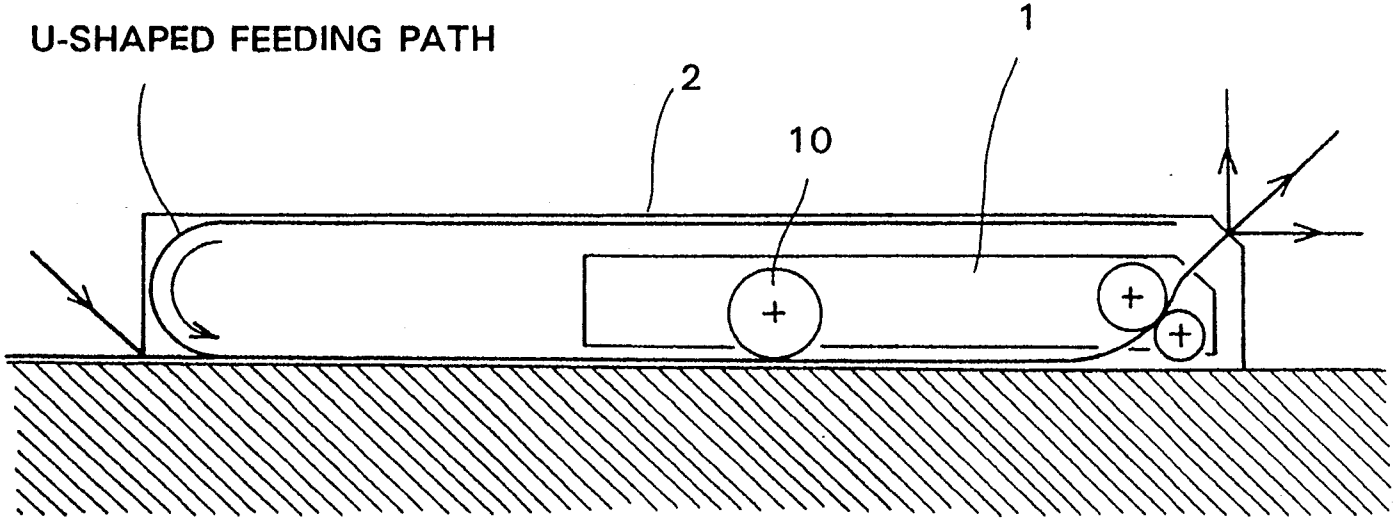
FIG. 3 is a diagram for explaining the principle of the present invention.

FIG. 3 is a diagram for explaining the principle of this invention, and FIGS. 4A through 4F and FIGS. 5A through 5F illustrate the positional relation between a hopper, a feeding path and a print process unit.

The basic structure of a printing apparatus includes a hopper, a feeding path and a print process unit. The positional relation between those three was studied. To reduce the occupying area of the apparatus, it is necessary to provide the hopper in the apparatus. Under this condition, the arrangement of the feeding path and print process unit was studied as shown in FIGS. 4A through 4F and 5A through 5F. In those diagrams, the print process unit is denoted by "1," the hopper by "2" and a photosensitive drum of the print process unit by "10."

Figure 1:
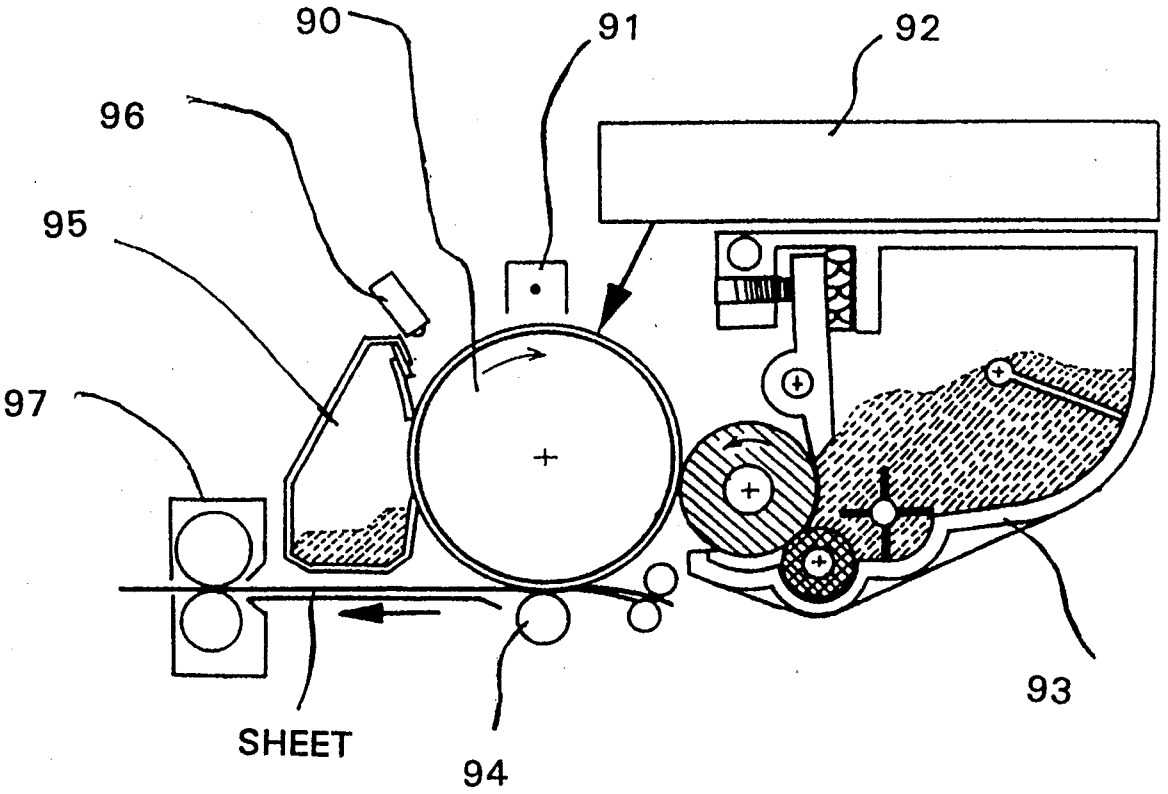
FIG. 1 PRIOR ART
FIG. 1 is an explanatory diagram of a conventional electrophotographic printer.
Figure 2A:
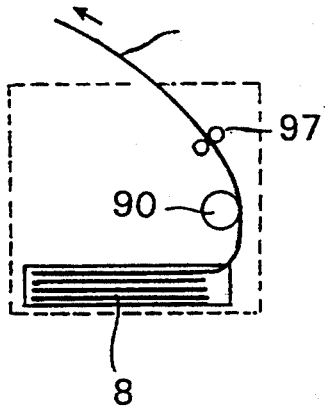
FIG. 2A PRIOR ART
FIGS. 2A, 2B, 2C, 2D are explanatory diagrams of conventional printing apparatuses having hoppers.
Figure 2B:
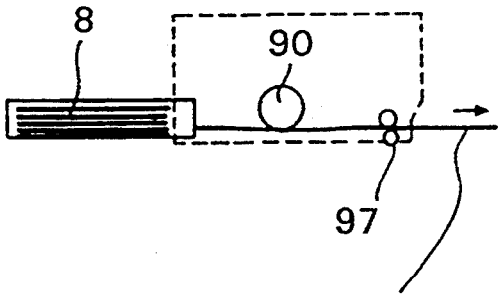
FIG. 2B PRIOR ART
Figure 2C:
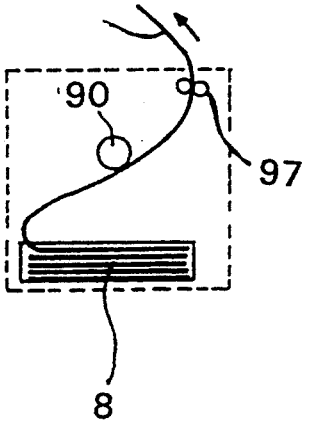
FIG. 2C PRIOR ART
Figure 2D:
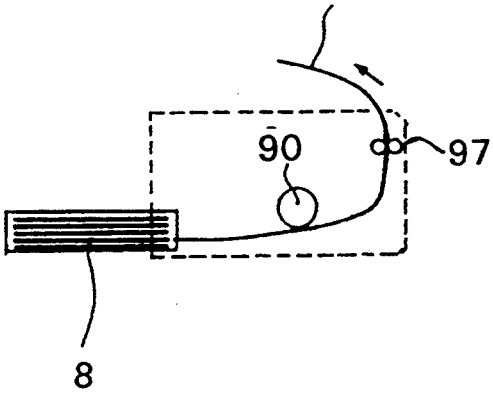
FIG. 2D PRIOR ART

In the conventional systems shown in FIGS. 2A and 2B in which printing is conducted while a sheet from the hopper is conveyed upward, the apparatuses become tall and it is difficult to make the apparatus slim. It is thus desirable to convey sheets in parallel to the hopper.

Shown in FIGS. 4C, 4D, 5E and 5F are feeding paths along which a sheet fed out from the hopper 2 is turned toward the hopper 2 at the end portion of the apparatus in the printing process. With those arrangements, if the printing apparatus is designed slim (e.g., about 50 mm tall), the curvature of the sheet conveyance at the end of the apparatus becomes large, increasing the rate of the occurrence of sheet jamming. Further, it is not easy to remove a jammed sheet. In this respect, the optimal feeding path is a U-shaped feeding path which allows a sheet to be turned to the opposite surface of the hopper 2 as shown in FIGS. 4A, 4B, 4E, 4F, and 5A to 5D.

Let us now consider the arrangement of the print process unit 1 in the feeding path. FIGS. 4E, 4F, 5A and 5B show systems which transfer a toner image on the photosensitive drum 10 onto a sheet at the sheet turning portion at the end of the apparatus. In those system, the mounting space for the print process unit 1 for forming a toner image on the photosensitive drum 10 become narrower, thus making it difficult to accomplish such systems. The structures shown in FIGS. 5C and 5D have the photosensitive drum 10 positioned out of the U-shaped feeding path and have the mounting space for the print process unit 1 at the end portion of the apparatus in order to provide sufficient space for the print process unit 1. In this type of structure, sheets protrude from the apparatus, thus increasing the apparatus-occupying area.

Figure 4A:
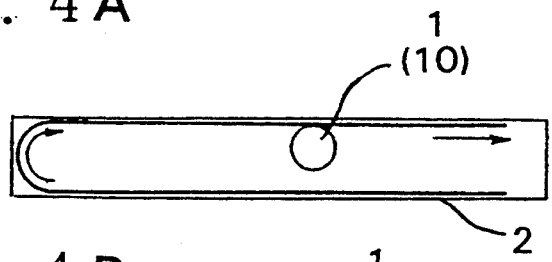
FIGS. 4A, 4B, 4C, 4D, 4E, 4F and FIGS. 5A, 5B, 5C, 5D, 5E, 5F are diagrams illustrating the positional relation between a hopper, a feeding path and a print process unit.
Figure 4B:
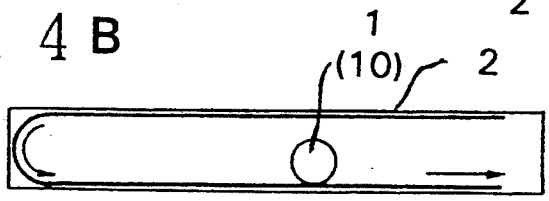
Figure 4C:
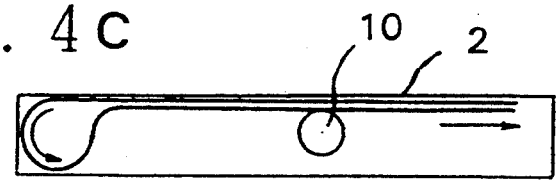
Figure 4D:
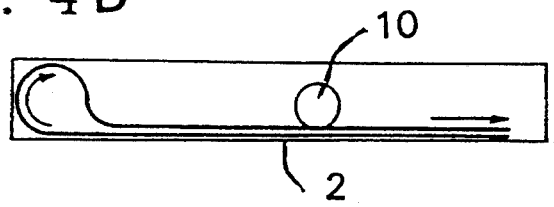
Figure 4E:
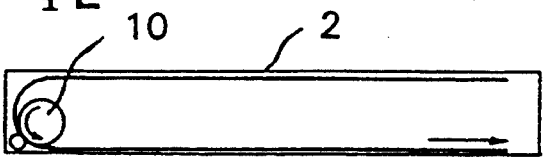
Figure 4F:
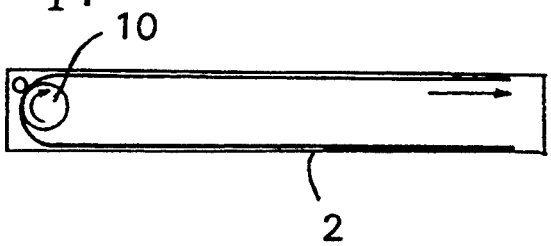
Figure 5A:
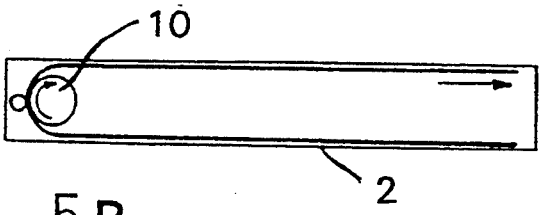
Figure 5B:
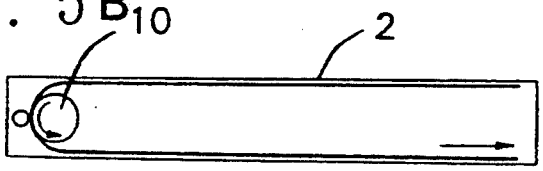
Figure 5C:
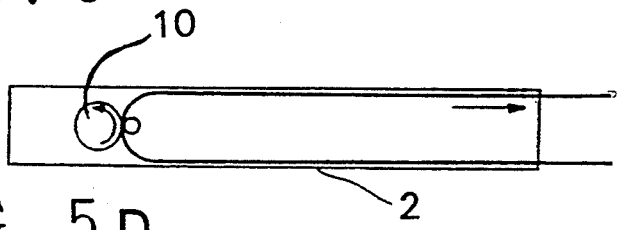
Figure 5D:
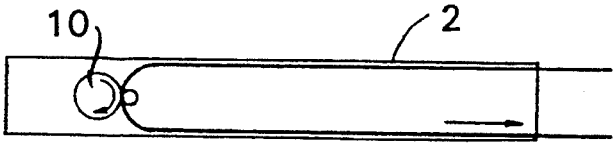
Figure 5E:
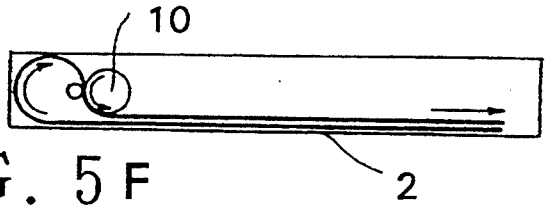
Figure 5F:
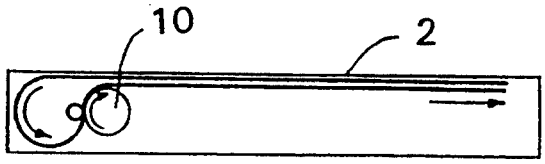

The structures shown in FIGS. 4A and 4B have the print process unit 1 provided in the space defined by the U-shaped feeding path and transfer a toner image on a sheet on the opposite surface of the hopper 2. With this design, the mounting space for the print process unit 1 can be secured on the opposite surface and sheets will not protrude from the apparatus, thus allowing the apparatus-occupying area to be made smaller and allowing the apparatus to be designed slim.

Therefore, the hopper 2 for retaining sheets and the U-shaped feeding path extending from one surface of the hopper 2 to the other surface thereof are provided as shown in FIG. 3. Further, the print process unit 1 is provided between the space defined by the U-shaped feeding path. The print process unit 1 transfers a toner image on the photosensitive drum 10 onto a sheet in the feeding path at the opposite surface of the hopper 2. The printed sheet can be discharged rightward, obliquely upward or upward in the diagram as indicated by the arrows.

Accordingly, the thickness of the apparatus is substantially the sum of the thickness of the hopper 2 and the thickness of the print process unit 1, so that the apparatus can be designed slim. In addition, the apparatus-occupying area becomes equal to the area of the hopper, so that the apparatus can be designed compact.

Figure 6:
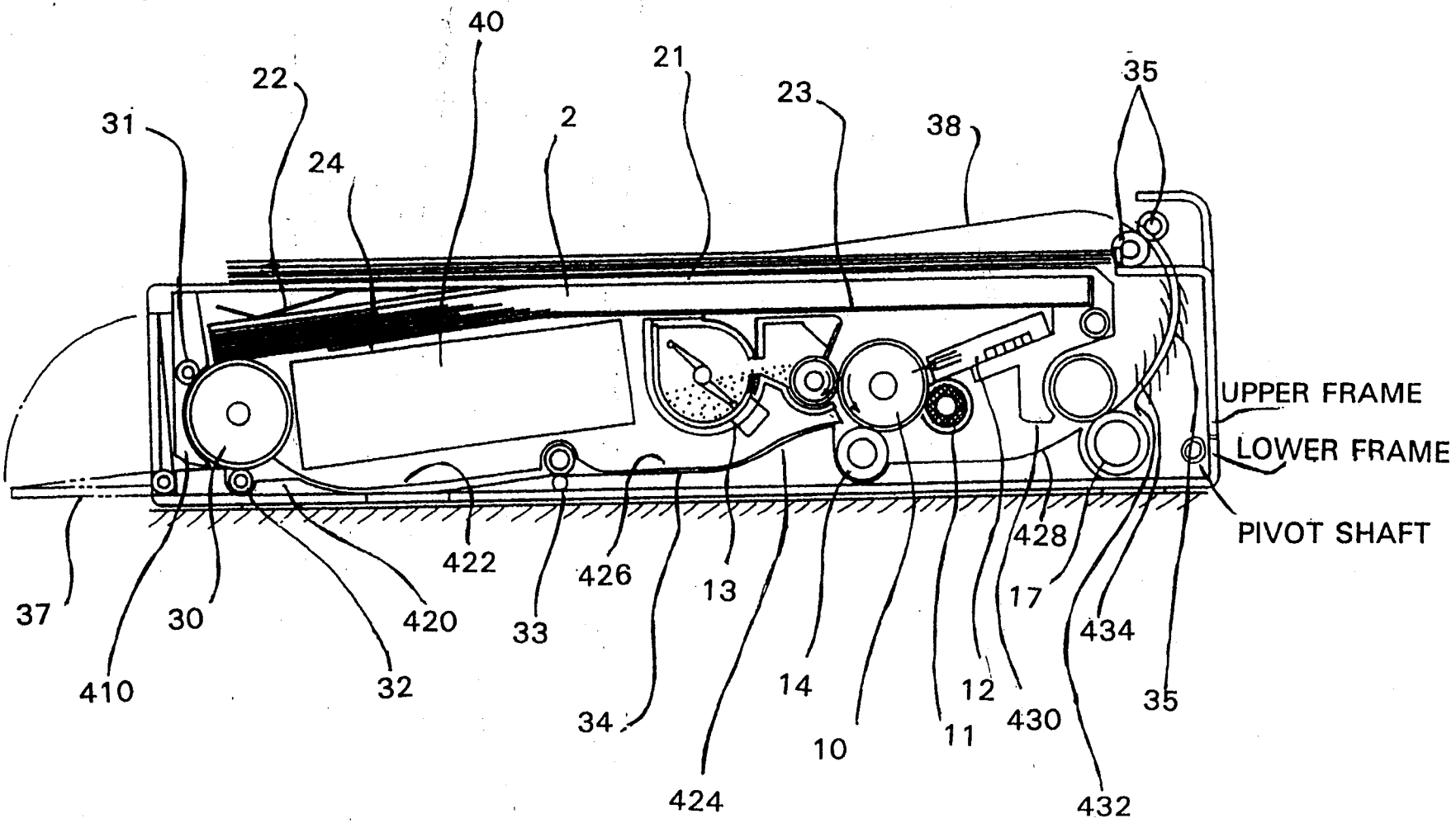
FIG. 6 is a cross-sectional view of a printing apparatus according to one embodiment of this invention.
Figure 7:
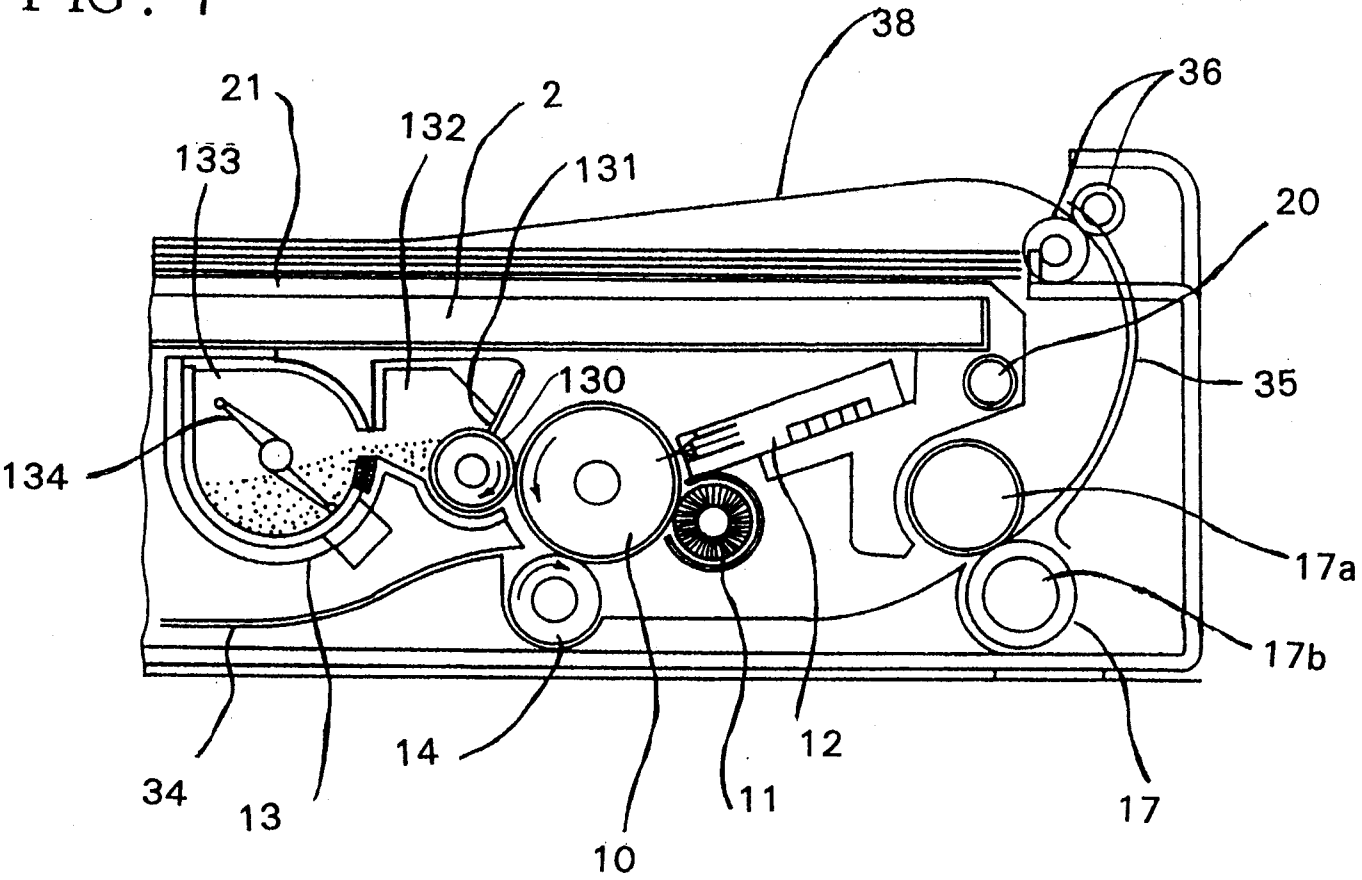
FIG. 7 is an enlarged view of the right half of the printing apparatus shown in FIG. 6.
Figure 8:
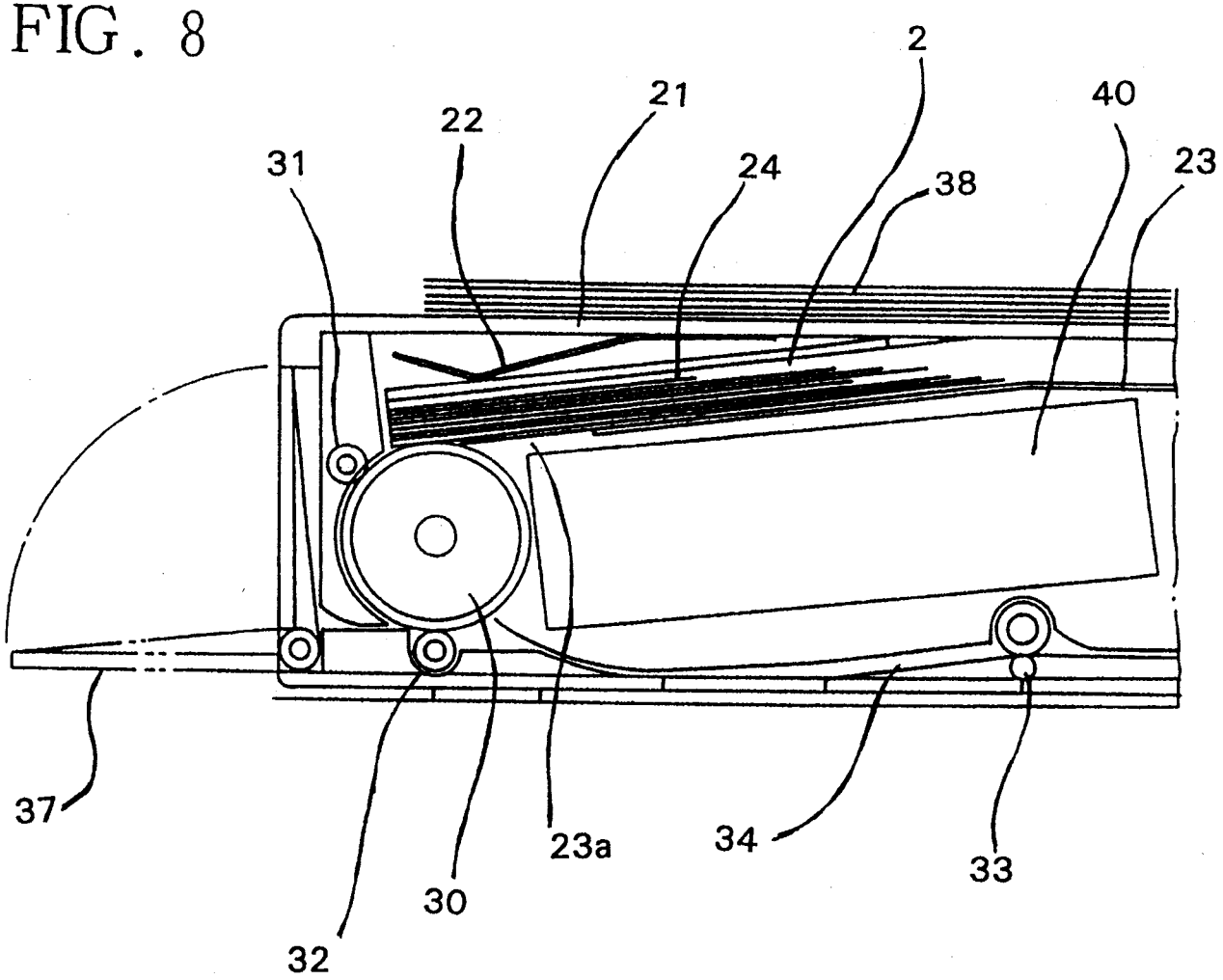
FIG. 8 is an enlarged view of the left half of the printing apparatus shown in FIG. 6.

FIG. 6 illustrates the structure of a printing apparatus according to one embodiment of this invention, FIG. 7 is an enlarged view of the right half of the apparatus shown in FIG. 6, and FIG. 8 is an enlarged view of the left half of the apparatus in FIG. 6. Those drawings illustrate an electrophotographic printer as a printing apparatus.

As shown in FIG. 6, the electrophotographic printer comprises an upper frame 300 and a lower frame 400. The upper frame 300 and the lower frame 400 is hinged about a pivot shaft 500 by using a well-known hinge mechanism (not shown). The hopper 2 is provided at the upper portion of the upper frame 300 of the printing apparatus. As shown in FIGS. 6, 7 and 8, this hopper 2 has a bottom plate 23 for supporting sheets 24, a top plate (cover) 21 rotatable around a rotary shaft 20, and a pressure leaf spring 22, provided on the top plate 21, for pressing the retained sheets 24 against a feed roller 30 that will be described later. An opening 23*a* for exposing the retained sheets is provided in front of the bottom plate 23 in association with the pressure leaf spring 22. The hopper 2 is provided on one side of the U-shaped feeding path.

The feed roller 30 is located at the position of the opening 23*a* in the bottom plate 23 of the hopper 2 to come in contact with the lowermost sheet among those retained in the hopper 2. The feed roller 30 feeds out a sheet 24 between a guide 410 and the feed roller 30 from the hopper 2 on one side of the U-shaped feeding path and carries the sheet 24 to a feeding path 34 on the opposite side of the U-shaped feeding path. The feeding path 34 formed and defined by a plurality of pairs of an upper and lower guides, clearly shown in FIG. 6, the feeding path is in parallel with and spaced appart from the bottom plate 23 of the hoper 2. The first and second pairs of the upper and lower guide 420, 422, 424, 426 guides the sheet in the feeding path between the feed roller 30 and a photosensitived drum 10.

The third pair of the upper and lower guide 428, 430 guides the sheet in the feeding path between the photosensitive drum 10 and a thermal fixing unit 17.

The lower guides 420, 424, 428 are provided to and supported by the lower frame 400, The uper guides 422, 426, 430 are provided to and supported by the upper frame 300. When the upper frame 300 is opened by rotating the upper frame about the pivot shaft 500, the feeding path is seperated between the upper guides 420, 424, 428 and the lower guide 422, 426, 430.

A guide roller 31 is provided on the hopper side, and a guide roller 32 on the side of the feeding path 34 with respect to the feed roller 30. Accordingly, a fed-out sheet can be smoothly conveyed to the feeding path 34.

A power/control circuit 40 for the apparatus and the print process unit 1 are provided between the hopper 2 and the feeding path 34 or the two sides of the U-shaped feeding path. The power/control circuit 40 is provided on the side of the feed roller 30 and the print process unit 1 is provided on the discharge side of the U-shaped feeding path, thus facilitating the discharge of the heat from the print process unit 1, particularly, from a thermal fixing unit 17. A guide roller 33 for helping the sheet conveyance to the print process unit 1 is provided in the feeding path 34 which constitutes the opposite side of the U-shaped feeding path.

The print process unit 1 will now be described. As shown in the partially enlarged view of FIG. 7, arranged around the photosensitive drum 10 are a brush charger 11, which rotates to charge the photosensitive drum 10, an optical unit 12 comprising a solid light-emitting element, such as an electrophotoluminescent (EL) element or LED array, a developing unit 13, and a transfer roller 14. This print process unit 1 employs a cleanerless process that uses no cleaner to collect the residual toners on the photosensitive drum 10 in order to make the print process unit 1 itself slim.

As shown in FIG. 7, the developing unit 13 is of a type which uses a one-component developer. The developing unit 13 has a paddling room 133 and a developing room 132. This paddling room 133 contains a one-component developer, which is stirred and carried to the developing room 132 by a paddle roller 134. Provided in the developing room 132 are a rotatable developing roller 130, which comes in contact with the photosensitive drum 10, and a blade 131 for restricting the thickness of a layer of toner (developer) on the developing roller 130.

As spherical polymerization toners with a uniform particle size are used for this one-component developer and the transfer roller 14 is used for toner transfer, the space between the sheet and the photosensitive drum 10 can be made smaller. Accordingly, the transfer voltage is applied evenly to the transfer roller 14, thus improving the transfer efficiency. As a result, the amount of the residual toners on the photosensitive drum 10 becomes small, facilitating the collection of the residual toners in the developing unit 13. Further, the rotatable brush charger 11 scrapes the residual toners off the photosensitive drum 10, removes the potential of the residual toners and uniformly disperses those toners on the photosensitive drum 10. This further facilitates the collection of the residual toners in the developing unit 13. It is therefore possible to collect the residual toners without providing a cleaner.

As the brush charger 11 and the optical unit 12, and the developing unit 13 are separately provided on both sides the photosensitive drum 10, the print process unit 1 can be designed short, thus contributing to making the apparatus slim.

The developing unit 13 is designed in such a way that even if the passage connecting the paddling room 133 to developing room 132 is made narrow and the apparatus is placed to stand upright, the developer in the paddling room 133 will not excessively be supplied to the developing room 132.

The thermal fixing unit 17, located at the rear portion of the feeding path 34, comprises a heat roller 17*a* and a backup roller 17*b*. The thermal fixing unit 17 holds a sheet between the heat roller 17*a* and backup roller 17*b* and applies heat and pressure to the sheet to fix the toner image on the sheet. Provided at the subsequent stage of the thermal fixing unit 17 are a discharge path 35 and a discharge roller 36. A sheet 38 carrying the fixed toner image is discharged onto the top plate 21 of the hopper 2 along the discharge path 35 by the discharge droller 36. The discharge path 35 is formed and defined by an upper guide 434 and a lower guide 432. The top of the hopper 2 is used as a stacker.

As shown in FIG. 8, a manual-insertion guide 37 for manually inserting a sheet is provided on the left side of the apparatus. The manual-insertion guide 37, when opened as illustrated, can allow a sheet to be manually inserted to between the feed roller 30 and the guide roller 32. The inserted sheet is conveyed to the feeding path 34 by the feed roller 30. The feed roller 30 can therefore be used to feed a manually-inserted sheet.

The action of this printing apparatus will now be described. The top plate 21 of the hopper 2 is opened around the rotary shaft 20 from the left end in FIG. 6. After sheets are set on the bottom plate 23, the top plate 21 is closed, completing the setting of sheets.

To execute printing, a sheet is fed out from the hopper 2 by the feed roller 30 and is carried along the U-shaped path to the feeding path 34.

In the print process unit 1, after the photosensitive drum 10 is charged by the brush charger 11, the optical unit 12 subjects the photosensitive drum 10 to image exposure to form an electrostatic latent image on the drum 10. The electrostatic latent image on the photosensitive drum 10 is developed by the developing unit 13, forming a toner image on the drum 10. The toner image is transferred on a sheet conveyed along the feeding path 34 by the transfer roller 14. After passing between the photosensitive drum 10 and the transfer roller 14, the sheet carrying the transferred toner image is sent to the thermal fixing unit 17 where the toner image is thermally fixed on the sheet. The image-fixed sheet is conveyed along the discharge path 35 and is discharged to be stacked on the top plate 21 of the hopper 2 by the discharge roller 36.

A sheet inserted through the manual-insertion guide 37 is fed out to the feeding path 34 by the feed roller 30. After the toner image likewise formed on the photosensitive drum 10 is transferred on this sheet by the transfer roller 14, the toner image is thermally fixed by the thermal fixing unit 17. The image-fixed sheet is conveyed along the discharge path 35 and is discharged to be stacked on the top plate 21 of the hopper 2 by the discharge roller 36.

As described above, sheets are fed along the U-shaped feeding path and the hopper 2 is disposed on one side of the U-shaped feeding path. The print process unit 1 is provided between the two sides of the U-shaped feeding path so that the toner image is transferred on a sheet at the opposite side of the U-shaped feeding path. This design can reduce the apparatus-occupying area nearly to the size of sheets and can make the height of the apparatus to the height of the print process unit 1 plus the height of the hopper 2. In other words, the printing apparatus can be made compact and slim.

In this embodiment, sheets can be set from the upper portion of the apparatus, facilitating the sheet setting. Further, the hopper 2 can be used as a stacker.

Figure 9A:
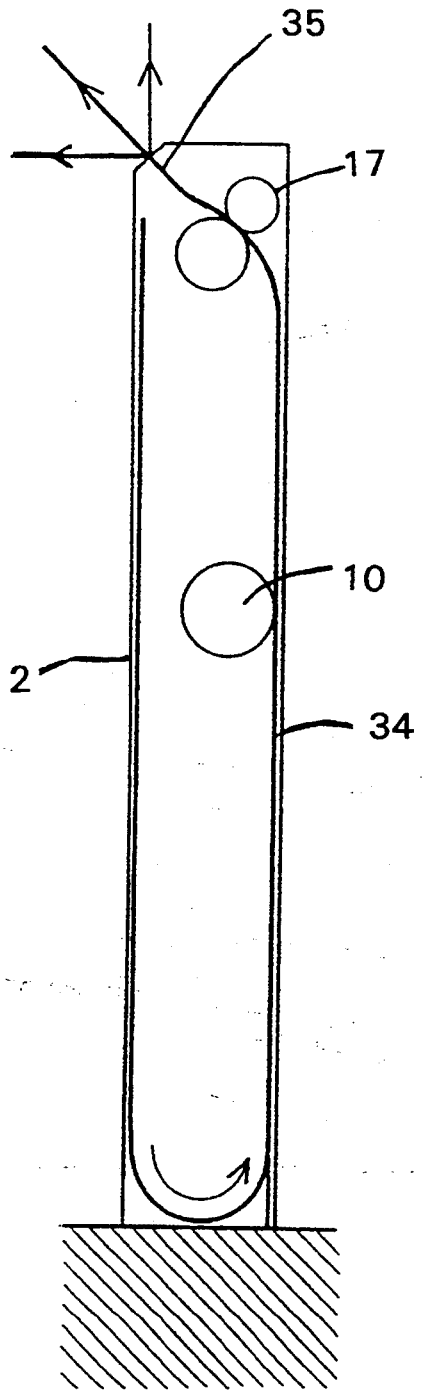
FIGS. 9A and 9B illustrate the printing apparatus in FIG. 6 standing upright.
Figure 9B:
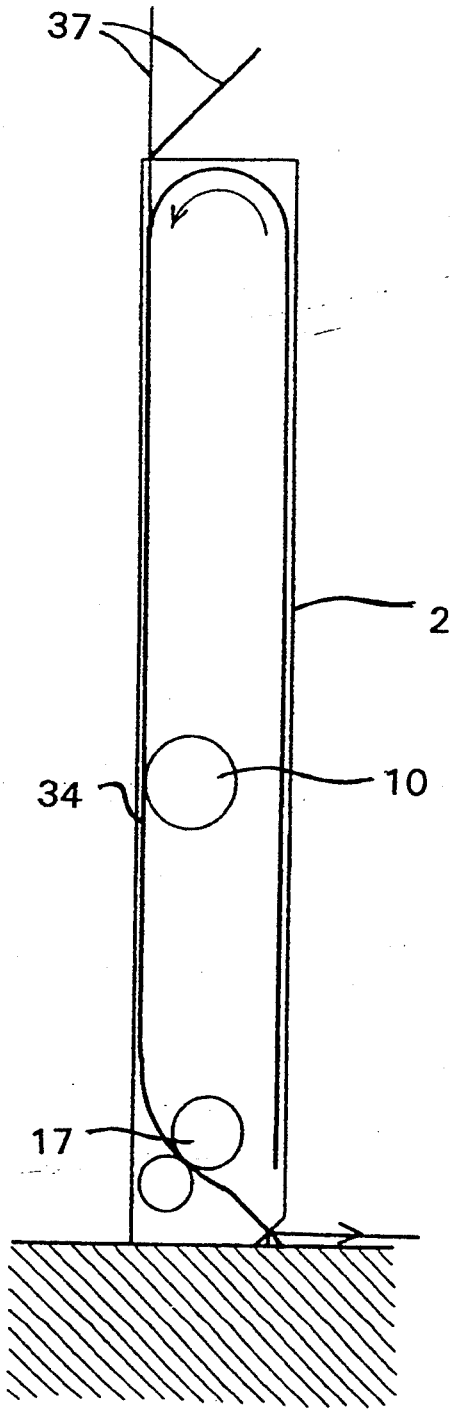

FIGS. 9A and 9B illustrate the printing apparatus in FIG. 6 standing upright. While FIGS. 6 through 8 illustrate the apparatus placed horizontally in use, the apparatus can be placed upright in use as shown in FIGS. 9A and 9B.

As shown in FIG. 9A, the printing apparatus when in use can be placed with the feed roller (30) side facing down. In this upright position, a sheet from the hopper 2 is fed out and carried upward along the feeding path 34 by the feed roller 30, and a toner image on the photosensitive drum 10 is transferred on the sheet and is thermally fixed by the thermal fixing unit 17. At this time, the sheet can be discharged upward, obliquely upward or horizontally as indicated by the arrows in the diagram depending on the direction of the discharge path 35.

As shown in FIG. 9B, the printing apparatus when in use may also be placed with the thermal fixing unit (17) side facing down. In this upright position, a sheet from the hopper 2 is fed out and carried downward along the feeding path 34 by the feed roller 30, and a toner image on the photosensitive drum 10 is transferred on the sheet and is thermally fixed by the thermal fixing unit 17. If the discharge roller 36 in FIG. 6 is omitted at this time, the sheet can be discharged horizontally. If the discharge roller 36 is provided, of course, the sheet can be discharged upward along the hopper 2.

As the printing apparatus can be placed upright as well as sideways, the apparatus-occupying area can be reduced, thus resulting in the reduction in the space on a desk for the printing apparatus.

Figure 10:
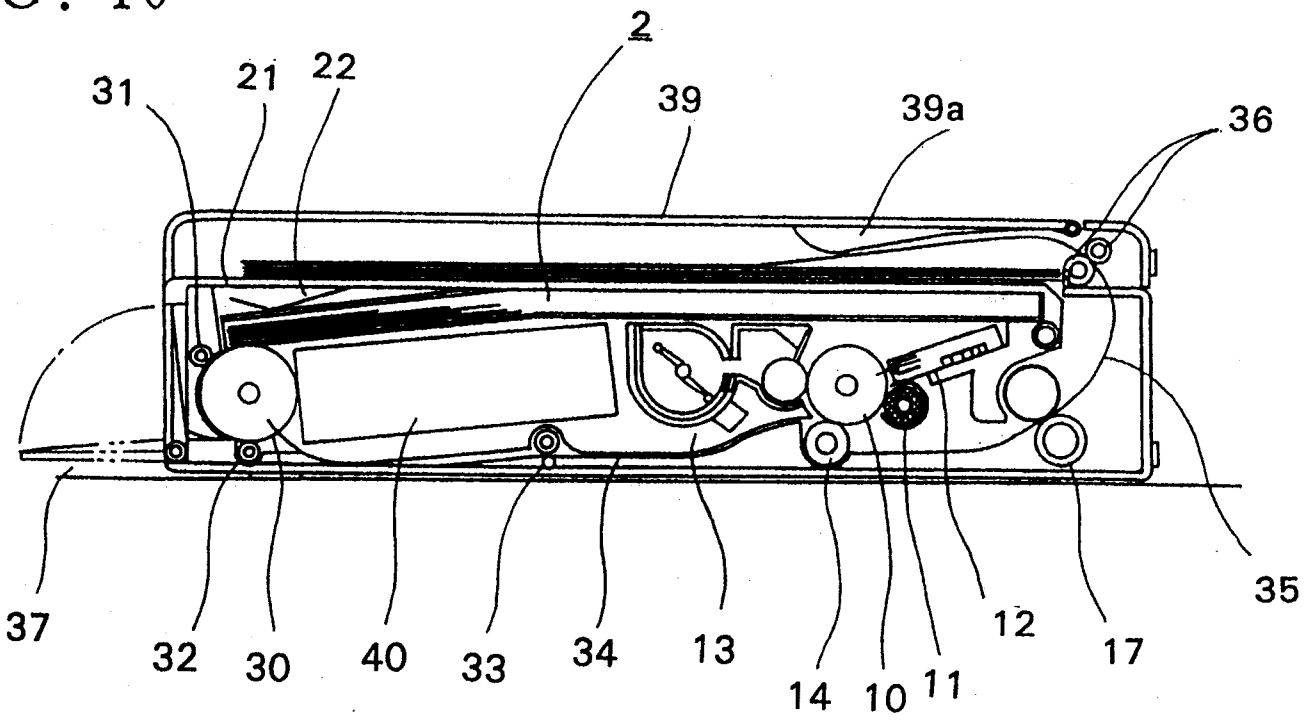
FIG. 10 is a cross-sectional view of a modification of this invention.
Figure 11:
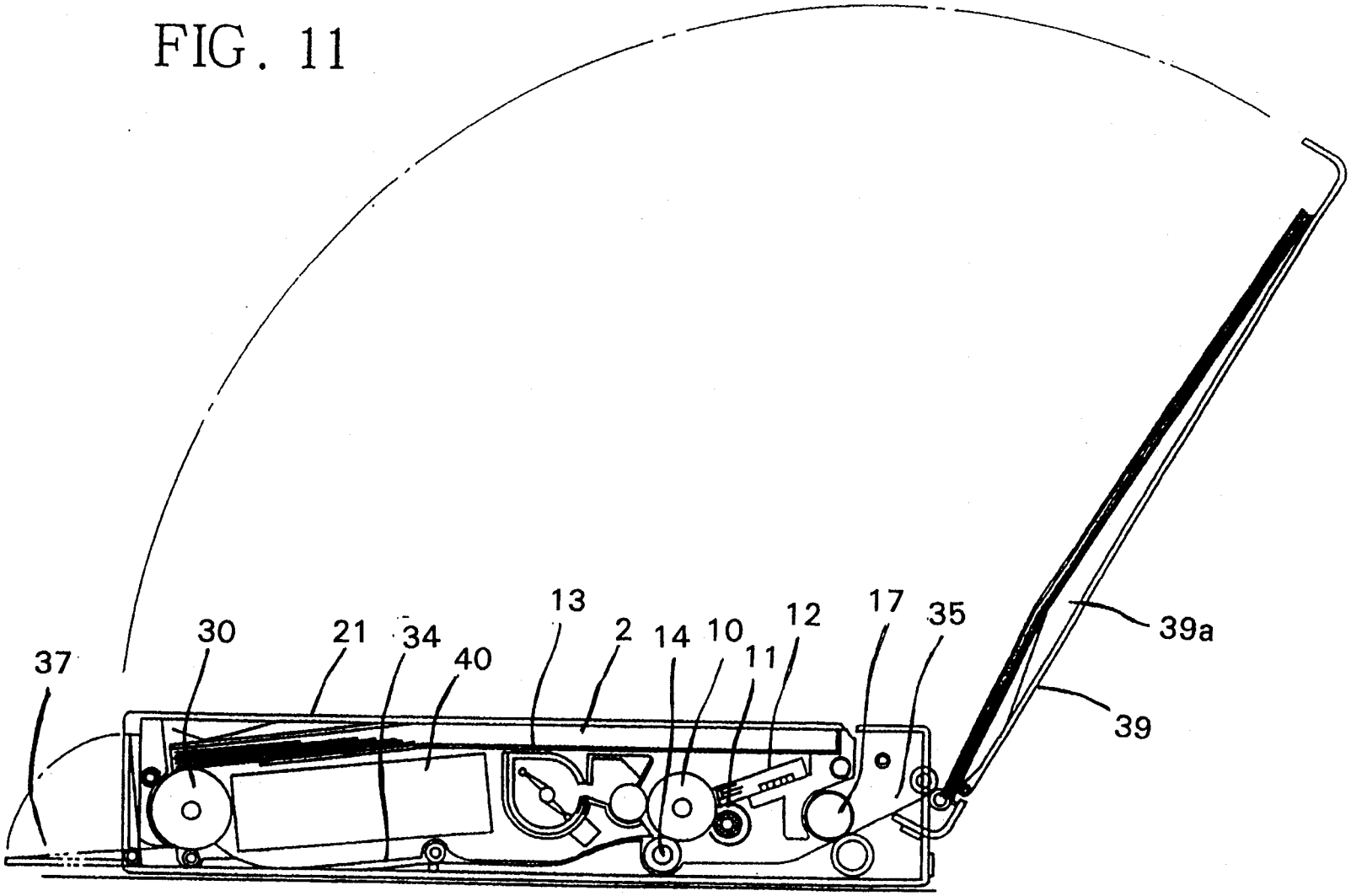
FIG. 11 is a diagram showing the printing apparatus in FIG. 10 with covers open.

A description will now be given of modifications of the present invention. FIG. 10 illustrates the structure of one modification of this invention, FIG. 11 shows the printing apparatus in FIG. 10 with its covers open, FIG. 12 is a diagram for explaining how the printing apparatus in FIG. 10 is placed, and FIGS. 13A through 13D are diagrams for explaining how the printing apparatus in FIG. 10 is used.

As shown in FIG. 10, a cover 39 is added to the printing apparatus having the structure shown in FIG. 6. This cover 39 serves to cover the stacker provided on the top plate 21 of the hopper 2. The cover 39 has a sheet guide 39*a* provided on the side of the discharge roller 36. The use of the cover 39 can prevent discharged sheets from scattering on the stacker and can permit another apparatus to be placed on the printing apparatus.

This cover 39 is rotatable by a rotating mechanism (not shown) provided on the side of the discharge roller 36. As the cover 39 is opened as shown in FIG. 11, therefore, the cover 39 can be used as a guide to stack sheets vertically when the apparatus is placed sideways.

Figure 12:
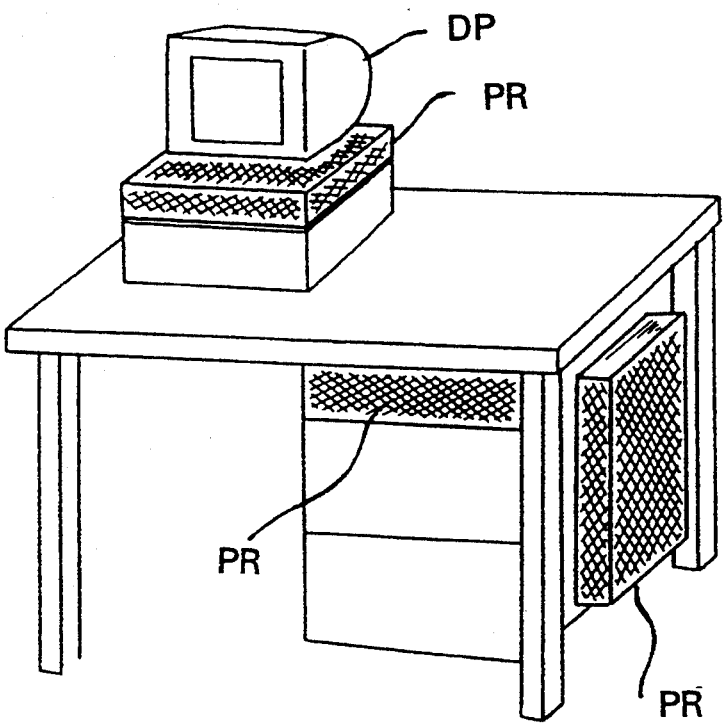
FIG. 12 is a diagram exemplifying how the printing apparatus in FIG. 10 is placed.
Figure 13A:
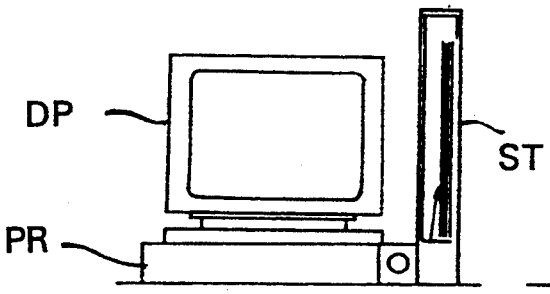
FIGS. 13A, 13B, 13C, 13D are diagrams exemplifying how the printing apparatus in FIG. 10 is used.
Figure 13B:
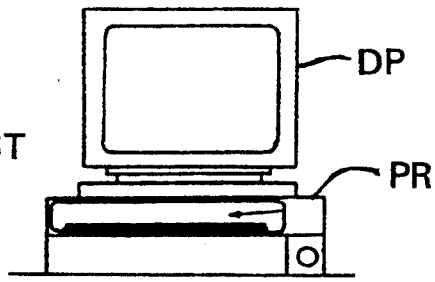

The provision of the cover 39 over the stacker can permit a display device DP to be placed on the printing apparatus PR set sideways on a desk as shown in FIGS. 12 and 13B while printing is performed by the printing apparatus PR. Likewise, this printing apparatus PR can be placed in a drawer of the desk as shown in FIG. 12.

Figure 13C:
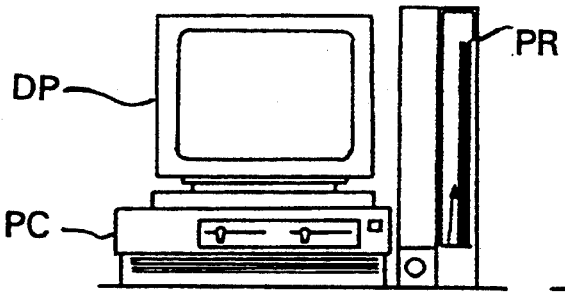
Figure 13D:
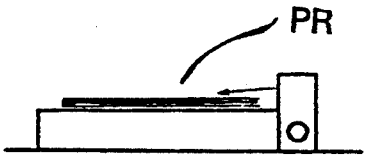

Even with the printing apparatus PR placed upright by the desk as shown in FIG. 12, sheets on the stacker will not be scattered around. Likewise, even with the printing apparatus PR placed upright by a personal computer PC desk as shown in FIG. 13C, sheets on the stacker will not be scattered around.

The printing apparatus PR may also be placed sideways under the display device DP with only the stacker ST placed upright as shown in FIG. 13A. FIG. 13E illustrates the printing apparatus PR with no cover 39 as shown in FIG. 6, placed sideways for a standalone usage.

Figure 14:
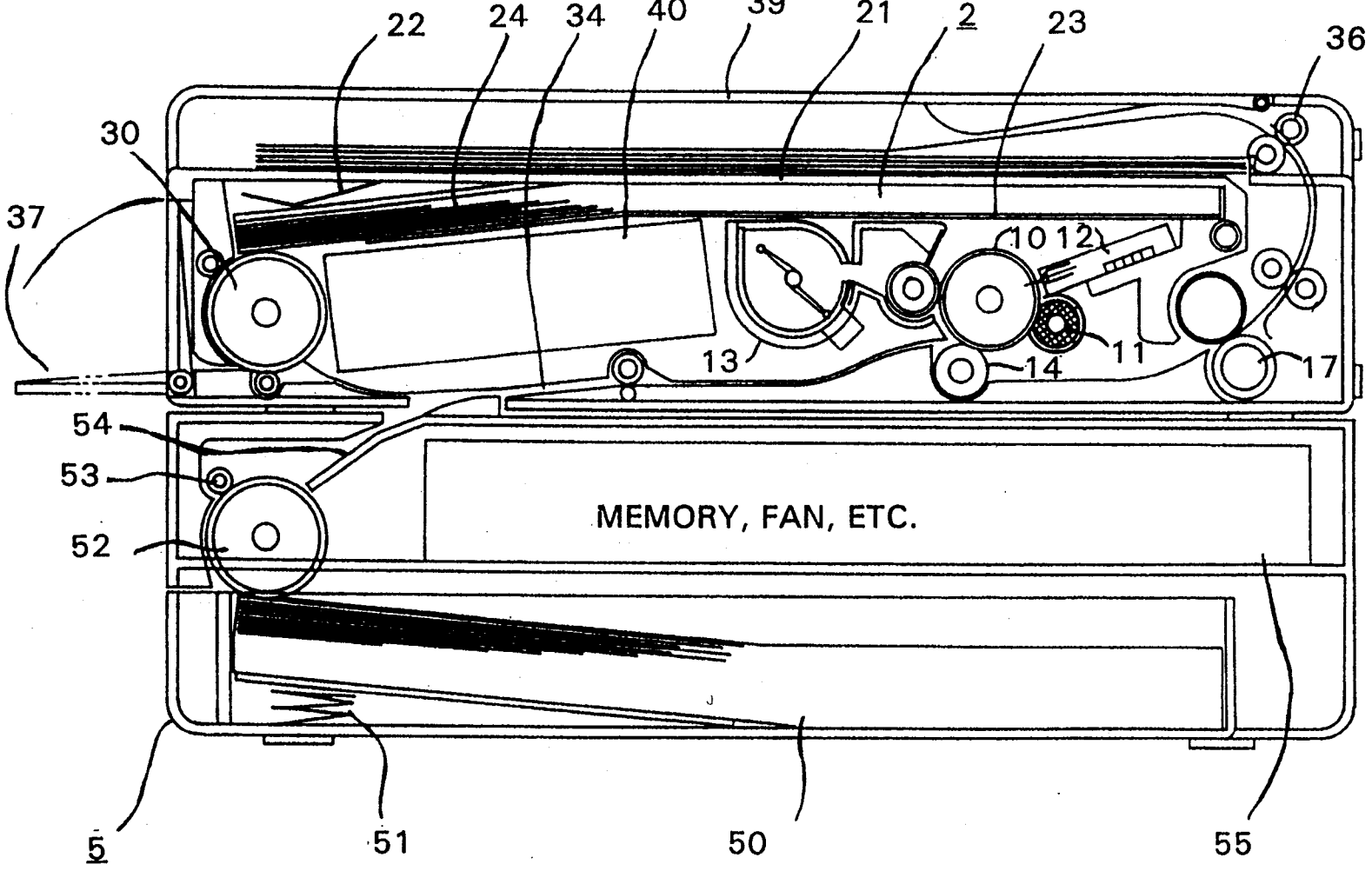
FIG. 14 is a diagram showing the structure of another modification of this invention.

FIG. 14 illustrates the structure of a printing apparatus according to another modification of this invention. In this embodiment, as the sheet capacity of the hopper 2 of the printing apparatus is small, an expansion unit 5 is provided in the printing apparatus in FIG. 10 to ensure continuous printing on a large number of sheets.

Referring to FIG. 14, the expansion unit 5 is provided under the printing apparatus. This expansion unit 5 has a sheet hopper 50 for retaining sheets, a feed roller 52 for feeding sheets from the hopper 50, a pressure leaf spring 51 for pressing the sheets in the hopper 50 against the feed roller 52, a guide roller 53 for the feed roller 52, a guide member 54 for guiding a fed sheet to the feeding path 34 of the printing apparatus, and an expansion circuit 55, such as memory or fan.

As a large number of sheets can be retained in the hopper 50 of the expansion unit 5, sheets will not run out even when continuous printing is executed. Further, when a printer buffer is provided in the expansion circuit 55, print data from a computer can be temporarily stored in the printer buffer. This can reduce a burden on the computer. Further, a fan may be provided in the expansion circuit 55, so that the print process unit 1 of the printing apparatus, which becomes hot through a continuous operation, can be cooled from the below by the fan.

A communication adapter for LAN or the like, a hard disk drive, a floppy disk drive, or the like may also be provided in the expansion unit 55.

Figure 15:
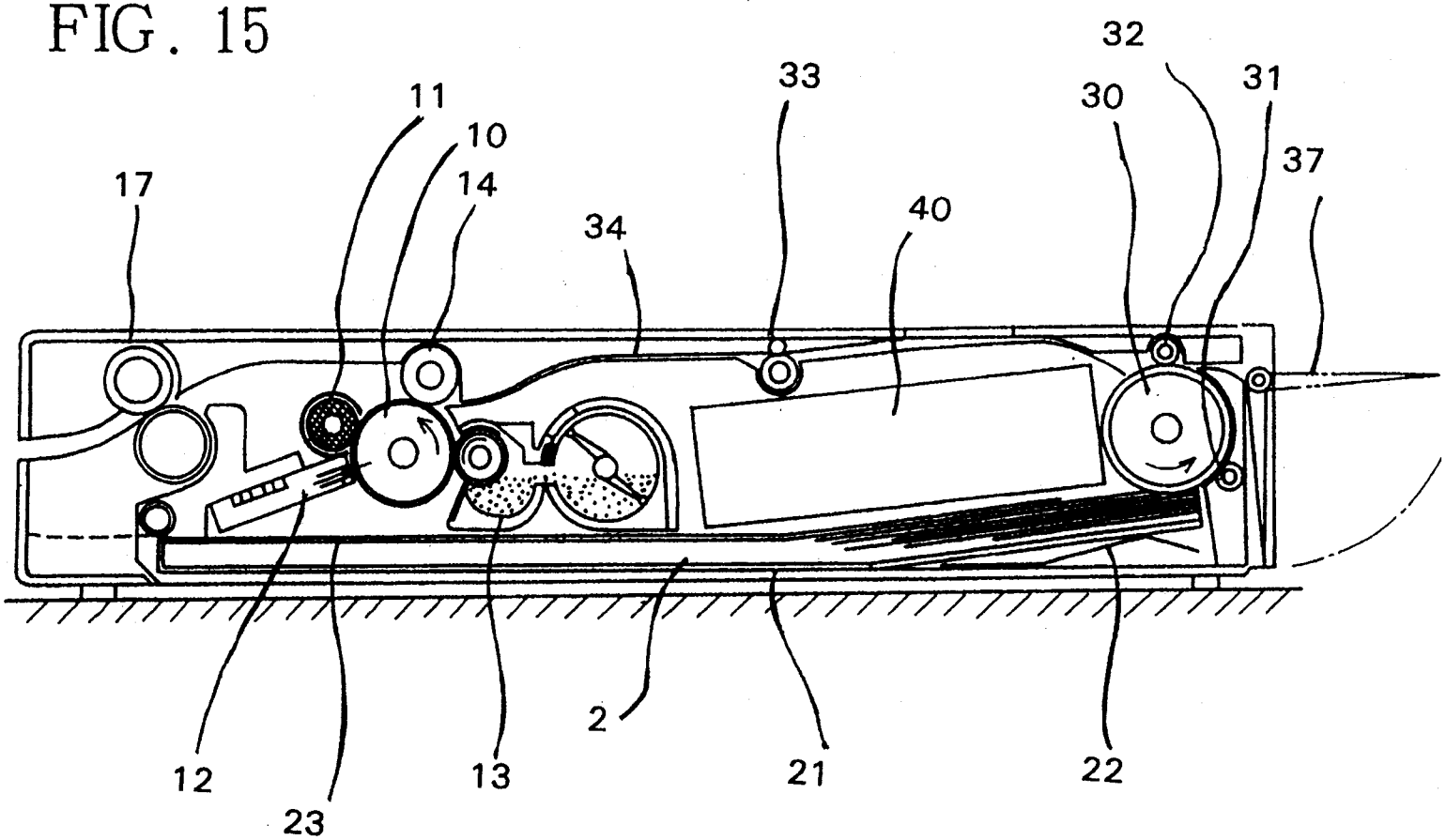
FIG. 15 is a diagram showing the structure of a further modification of this invention.

FIG. 15 illustrates the structure of a printing apparatus according to a further modification of this invention. The embodiment in FIG. 15 is the embodiment in FIG. 6 with the hopper 2 located at the lower portion of the apparatus. More specifically, as shown in FIG. 15, provided at the lower portion of the apparatus is the hopper 2, which retains sheets on the top plate 21, presses the sheets with the bottom plate 23 and causes the pressure spring 22 to press the sheets against the feed roller 30. A sheet is fed out to the print process unit 1 along the feeding path 34 at the upper portion of the apparatus by the feed roller 30. In the print process unit 1, a toner image on the photosensitive drum 10 is transferred on the sheet by the transfer roller 14. The toner image on the sheet is fixed by the thermal fixing unit 17, and the sheet is then discharged leftward at the left end of the apparatus.

When the hopper 2 is designed to be attached to or detached from the apparatus from the left end or right end of the apparatus, sheets can be set easily. When the printing apparatus is placed sideways, this design allows sheets to be discharged from the upper portion of the apparatus, making it easy to take out the sheets. This printing apparatus can be placed upright as per the above-described embodiment shown in FIG. 6.

Figure 16:
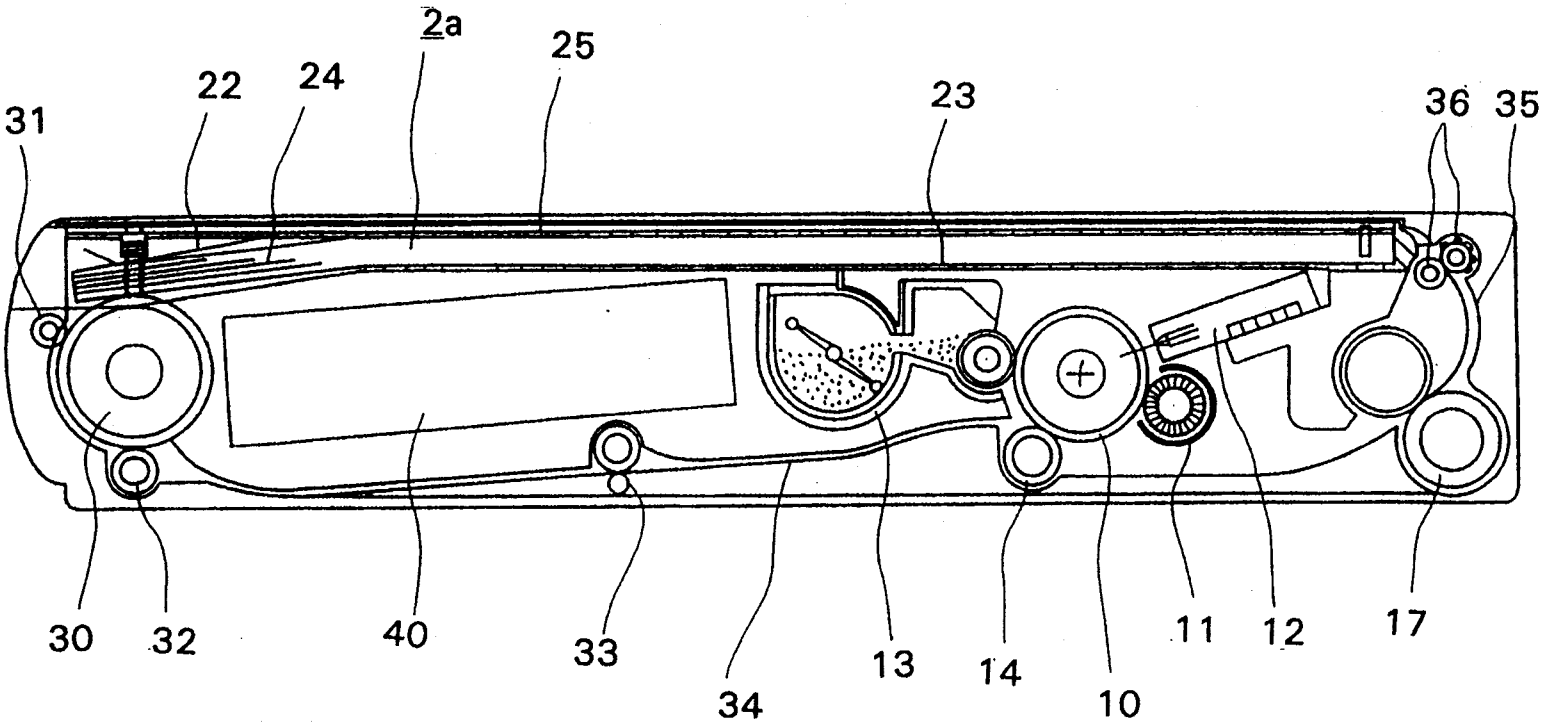
FIG. 16 is a diagram showing the structure of a still further modification of this invention.
Figure 17:
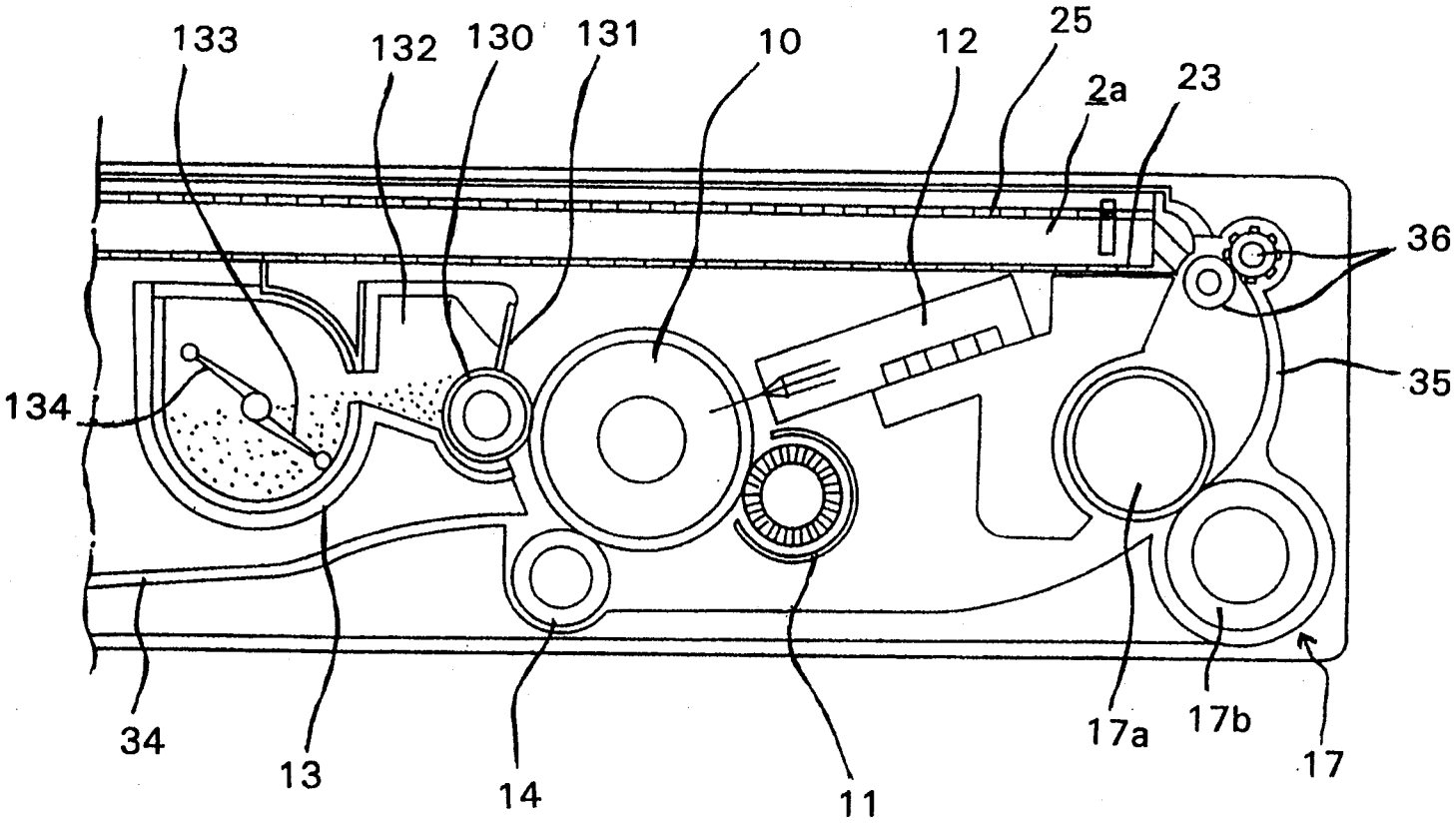
FIG. 17 is an enlarged view of the right half of the printing apparatus shown in FIG. 16.
Figure 18:
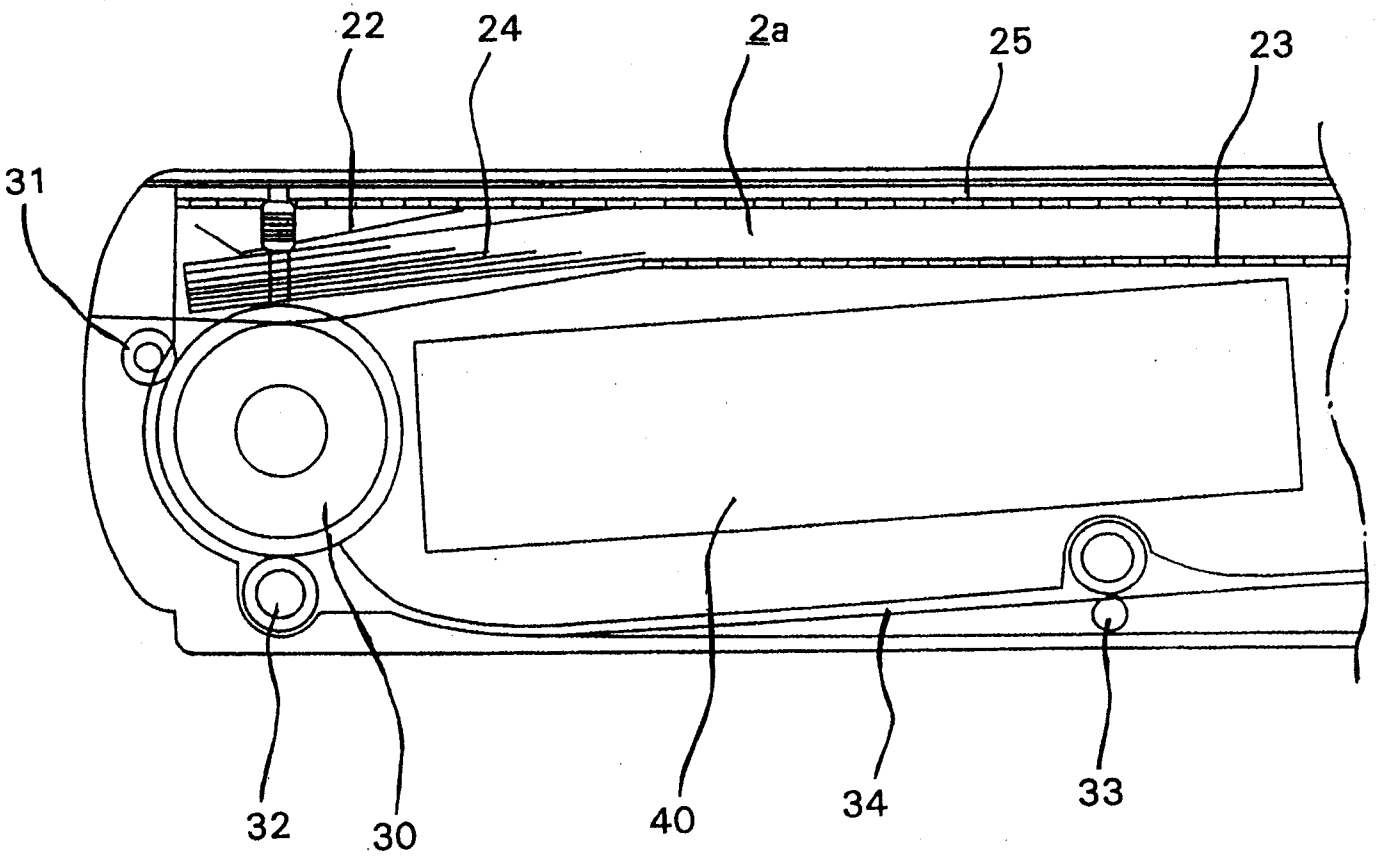
FIG. 18 is an enlarged view of the left half of the printing apparatus shown in FIG. 16.

A still further modification of the printing apparatus of this embodiment will be described below. FIG. 16 is a cross-sectional view showing the structure of a still further modification of this invention, FIG. 17 is an enlarged view of the right half of the printing apparatus shown in FIG. 16, and FIG. 18 is an enlarged view of the left half of the printing apparatus shown in FIG. 16.

The structure of this modification is basically the same as that of the printing apparatus shown in FIG. 6, with a difference lying in the structure of the hopper 2. Those diagrams use like or same reference numerals as used in FIG. 6 to denote corresponding or identical portions. In FIG. 16, reference numeral "*2a*" denotes a hopper which retains printed sheets as well as unprinted sheets. This hopper *2a* has a bottom plate 23 for supporting unprinted sheets 24, a movable partition plate 25 provided inside the hopper *2a* for separating the unprinted sheets from printed sheets, and a pressure spring 22, provided on the partition plate 21, for pressing the retained sheets 24 against a feed roller 30 that will be described later. The hopper *2a* is provided on one side of the U-shaped feeding path at the upper portion of the apparatus.

The feed roller 30 feeds out a sheet 24 from the hopper *2a* on one side of the U-shaped feeding path and carries the sheet 24 to a feeding path 34 on the opposite side of the U-shaped feeding path. A guide roller 31 is provided on the hopper side, and a guide roller 32 on the side of the feeding path 34 with respect to the feed roller 30.

A power/control circuit 40 for the apparatus and the print process unit 1 are provided between the two sides of the U-shaped feeding path. The power/control circuit 40 is provided on the side of the feed roller 30 and the print process unit 1 is provided on the discharge side of the U-shaped feeding path, thus facilitating the discharge of the heat from the print process unit 1, particularly, from a thermal fixing unit 17. A guide roller 33 for helping the sheet conveyance to the print process unit. 1 is provided in the feeding path 34 which constitutes the opposite side of the U-shaped feeding path.

Although the print process unit 1 basically has the same structure as the structure shown in FIGS. 6 and 7, its description will be given again with a slight supplemental explanation. As shown in FIG. 17, the print process unit 1 has a charger 11, an optical unit 12, a developing unit 13, and a transfer roller 14 arranged around the rotatable photosensitive drum 10. This print process unit 1 employs a cleanerless process that uses no cleaner to collect the residual toners on the photosensitive drum 10 in order to make the print process unit 1 itself slim.

A photosensitive material, such as an organic photosensitive body, Se photosensitive body or a-Si photosensitive body, may be used for the photosensitive drum 10. The charge 11 is constituted of a brush charger which has a conductive brush shaft having a diameter of 16 mm covered with conductive straight fibers. (e.g., "Lec," a product of Unitika Ltd.), applied with an AC voltage with an offset voltage of −650 V and a peak-to-peak of 1.2 KV at a frequency of 800 Hz. This brush charger 11 evenly charges the photosensitive drum 10 so that the surface potential of the drum 10 becomes about −650 V. Beside the charging brush, a charging roller, a Colorton, a Scolotron, a charging solid, a flat type charging brush (fixed brush), etc. may be used for the charger 11.

The optical unit 12 exposes the evenly charged photosensitive drum 10 to a light image to form an electrostatic latent image thereon. This optical unit 12 is constituted of an electrophotoluminescent (EL) element (a product of Norma Co. Ltd.). A solid light-emitting element, such as an LED array, or the like may also be used for the optical unit 12.

The developing unit 13 is constituted of a one-component developing unit that uses a one-component developer. This developing unit 13 has a developing roller 130, which rotates around a metallic shaft to supply a developer to the electrostatic latent image on the photosensitive drum 10. In this embodiment, the developer in use is a one-component toner of a non-magnetic and insulating resin. The toners are polyester toners having a volume resistivity of $4\times10^{14}$ Ω·cm and an average particle size of 12 μm, with 0.5% of a silica additive.

The developing roller 130 in use is a porous urethane sponge (product name "Rubicell" from TOYO POLY- MER CO., LTD.) with an average porous size of 10 μm, about 200 cells per inch, a volume resistivity of $10^4$ Ω·cm to $10^7$ Ω·cm and a hardness of about 23° (Ascar C penetrometer). The developing roller 130 rotates at a peripheral speed of 175 mm/s, 2.5 times that of the photosensitive drum 10. This developing roller 130 is applied with a developing bias voltage, which is normally set to about −220 V as compared with the surface potential of the photosensitive drum 10 of −650 V. The contact pressure of the developing roller 130 to the photosensitive drum 10 is 3 g/mm.

A layer-thickness restricting blade 131 restricts the thickness of the toner layer on the developing roller 130 to a given thickness and charges the toners with a predetermined amount of electric charges. This layer-thickness restricting blade 131 is a stainless plate (SUS304-CSP-EH) of a thickness of 0.1 mm with the tip portion rounded to have R=0.05 mm. The pressure of this blade 131 against the developing roller 130 is set to 35 gf/cm.

A voltage of −100 V is applied between the layer-thickness restricting blade 131 and the developing roller 130. This reduces the dependency of the amount of charges of the charged toners on the environmental conditions and ensures long-lasting stable charging conditions. As the toners pass between the developing roller 130 and the layer-thickness restricting blade 131, therefore, charges are given to the toners by the frictional charging caused between the toners and the blade 131. At the same time, a voltage is given between the developing roller 130 and the layer-thickness restricting blade 131, supplying charges to the toners from the blade 131. That is, the toners are supplied with charges by the frictional charging and the latter supply of the charges. Therefore, an environment-dependent change and a time-dependent change in the amount of the charges of the toners becomes small, thus ensuring a stable amount of charges.

A paddling room 133 contains a one-component developer, which is paddled and supplied to a developing room 132 by a paddle roller 134 provided inside the room 133. The developing roller 130 is provided in the developing room 132.

As spherical polymerization toners with a uniform particle size are used for this one-component developer, the mechanical adhesion of toners to the photosensitive drum 10 is reduced and the clearance between the sheet and the toners becomes small at the time of image transfer, thus improving the transfer efficiency. Further, the transfer roller 14 is used as a transfer unit, the space between the sheet and the photosensitive drum 10 with the toners in between can be made smaller. Accordingly, the transfer voltage is applied evenly to the transfer roller 14, thus improving the transfer efficiency. As a result, the amount of the residual toners on the photosensitive drum 10 becomes small, facilitating the collection of the residual toners in the developing unit 13.

Further, the rotatable brush charger 11 scrapes the residual toners off the photosensitive drum 10, and uniformly disperses those toners on the photosensitive drum 10. This further facilitates the collection of the residual toners in the developing unit 13. Even without a cleaner, the residual toners can be collected by the developing roller 130 of the developing unit 13.

As the brush charger 11 and the optical unit 12, and the developing unit 13 are separately provided on both sides the photosensitive drum 10, the print process unit 1 can be designed short, thus contributing to making the apparatus slim. The developing unit 13 is designed in such a way that even if the passage connecting the paddling room 133 to developing room 132 is made narrow and the apparatus is placed to stand upright, the developer in the paddling room 133 will not excessively be supplied to the developing room 132.

The thermal fixing unit 17, located at the rear portion of the feeding path 34, comprises a heat roller **17*a* and a backup roller 17*b*. The thermal fixing unit 17 holds a sheet between the heat roller 17*a* and backup roller 17*b* and applies heat and pressure to the sheet to fix the toner image on the sheet. Provided at the subsequent stage of the thermal fixing unit 17 are a discharge path 35 for guiding the image-fixed sheet into the hopper 2*a*, and a discharge roller 36, located at the rear end of the discharge path 35 for discharging the sheet to the hopper 2*a*. A sheet carrying the fixed toner image is discharged onto the partition plate 21 in the hopper 2*a* along the discharge path 35 by the discharge roller 36. The hopper 2*a*** is used as a stacker.

The action of this printing apparatus will now be described. After sheets are set on the bottom plate 23 of the hopper **2*a*, and the partition plate 21 is placed on the sheets, completing the setting of sheets. To execute printing, a sheet is fed out from the hopper 2*a* by the feed roller 30 and is carried along the U-shaped path to the feeding path 34. In the print process unit 1, after the photosensitive drum 10 is charged by the brush charger 11, the optical unit 12 subjects the photosensitive drum 10 to image exposure to form an electrostatic latent image on the drum 10. The electrostatic latent image on the photosensitive drum 10 is developed by the developing unit 13, forming a toner image on the drum 10. The toner image is transferred on a sheet conveyed along the feeding path 34 by the transfer roller 14**.

After passing between the photosensitive drum 10 and the transfer roller 14, the sheet carrying the transferred toner image is sent to the thermal fixing unit 17 where the toner image is thermally fixed on the sheet. The image-fixed sheet is conveyed along the discharge path 35 and is discharged to be stacked on the partition plate 21 of the hopper **2*a* by the discharge roller 36**.

In this example, the positional relation between the hopper **2*a*, feeding path and print process unit is determined as shown in FIG. 6 to make the apparatus compact and slim. More specifically, sheets are fed along the U-shaped feeding path and the hopper 2*a* is disposed on one side of the U-shaped feeding path. The print process unit 1 is provided between the two sides of the U-shaped feeding path so that the toner image is transferred on a sheet at the opposite side of the U-shaped feeding path. This design can reduce the apparatus-occupying area nearly to the size of sheets and can make the height of the apparatus to the height of the print process unit 1 plus the height of the hopper 2*a***. In other words, the printing apparatus can be made compact and slim.

This printing apparatus may be placed upright with the thermal fixing unit (17) side facing down when in use as well as placed sideways with the feeding path (34) side facing down as in FIG. 16. In this upright position, a sheet from the hopper **2*a* is fed out and carried downward along the feeding path 34 by the feed roller 30, and a toner image on the photosensitive drum 10 is transferred on the sheet and is thermally fixed by the thermal fixing unit 17. The image-fixed sheet is then discharged on the hopper 2*a***. As the printing apparatus can be placed upright as well as sideways, the apparatus-occupying area can be reduced, thus resulting in the reduction in the space on a desk for the printing apparatus.

Figure 19:
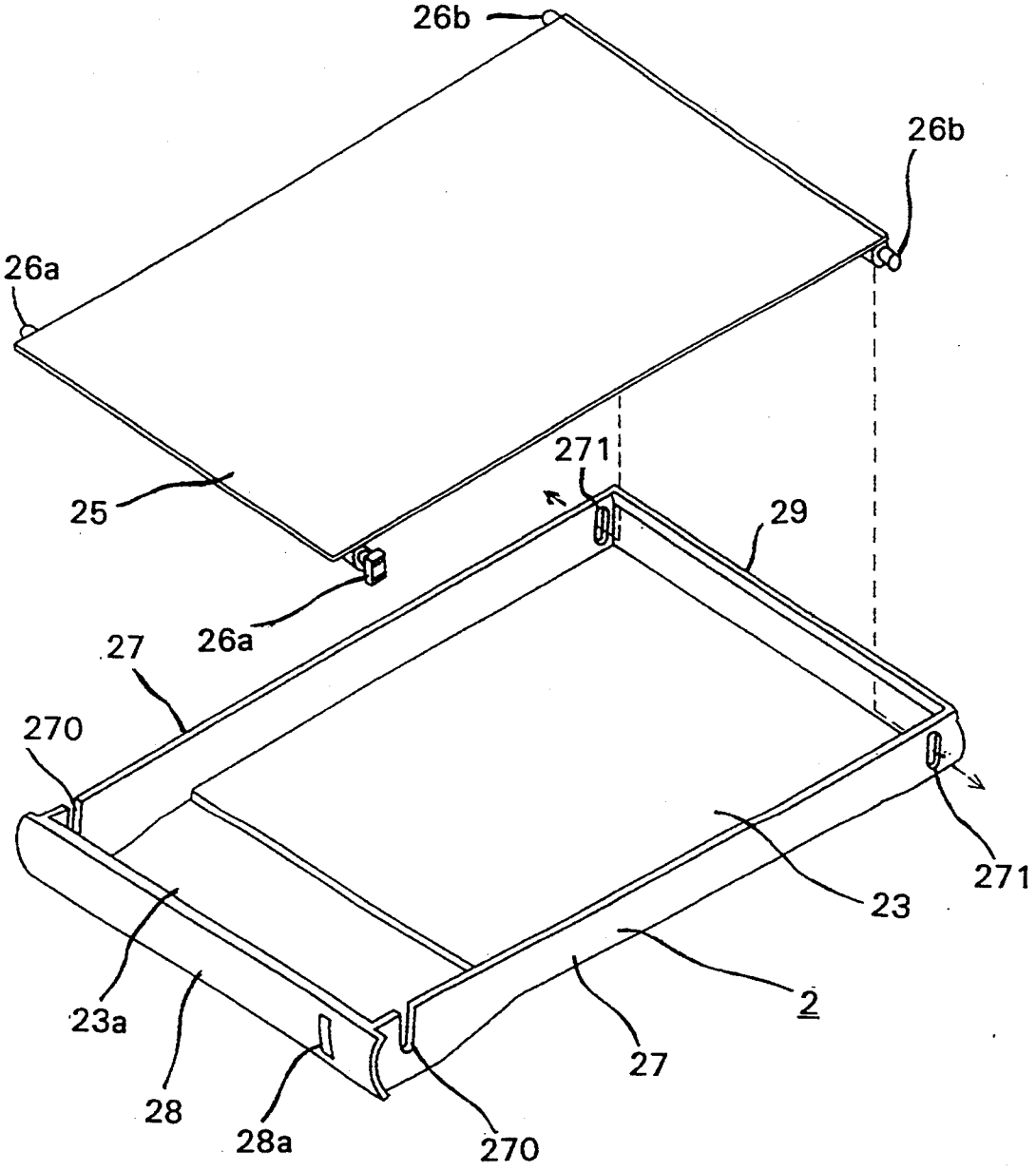
FIG. 19 is a perspective view of a hopper of the printing apparatus in FIG. 16.
Figure 20:
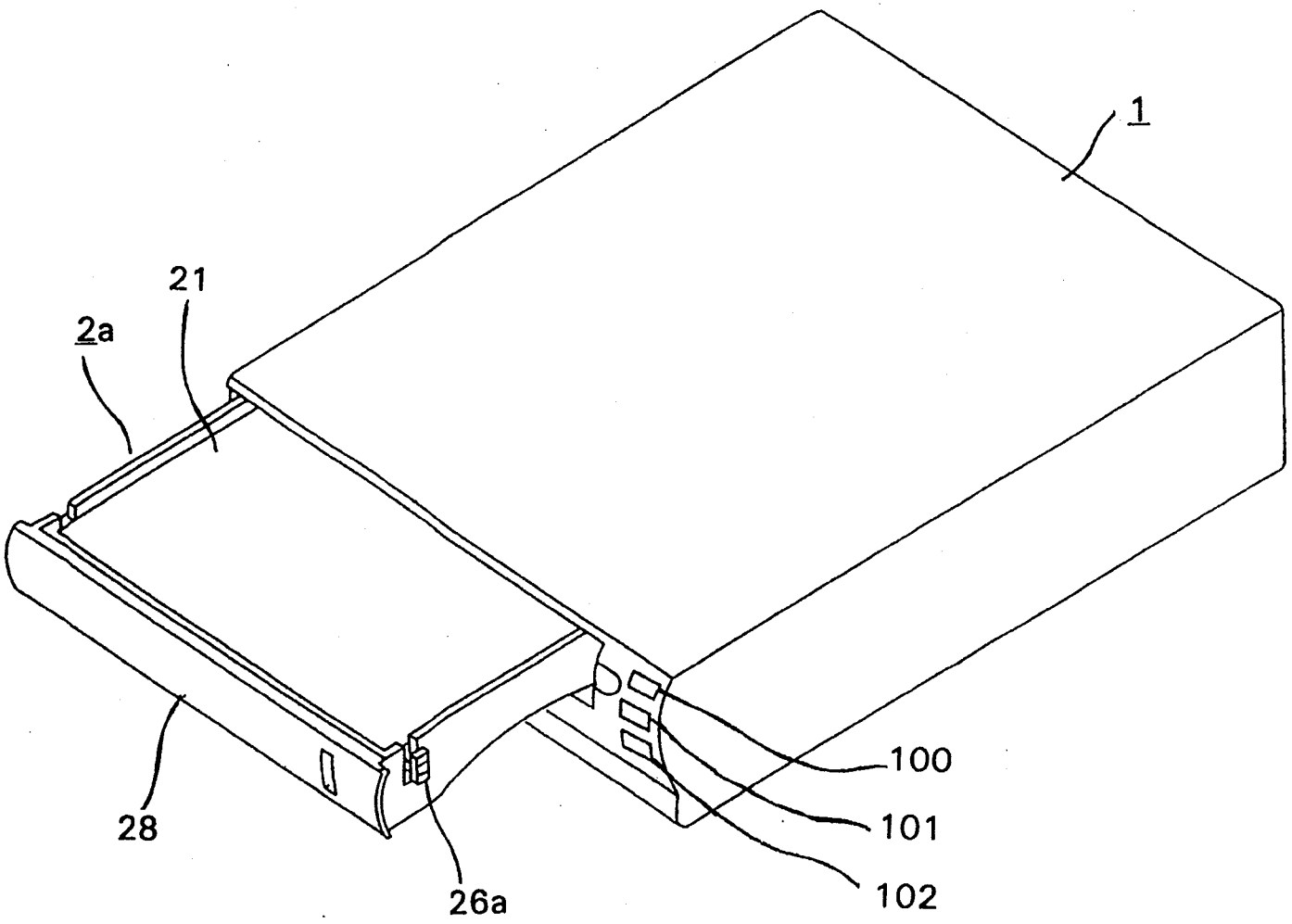
FIG. 20 is a diagram showing the hopper in FIG. 19 mounted in a printing apparatus.
Figure 21A:
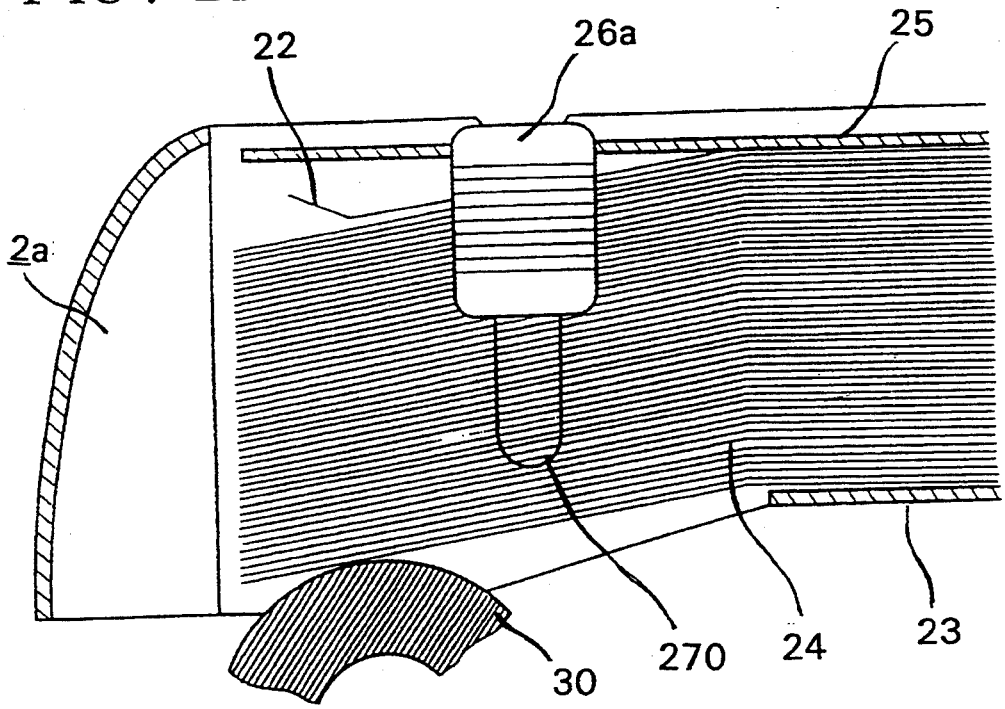
FIGS. 21A and 21B are diagrams for explaining the action of the front end portion of the hopper.
Figure 21B:
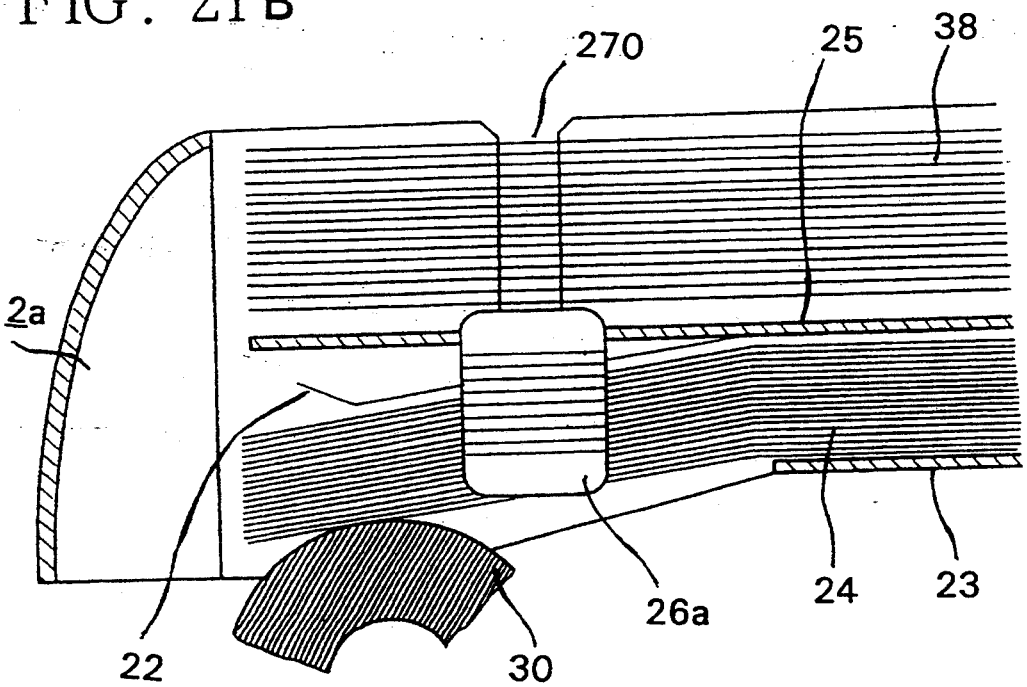
Figure 22A:
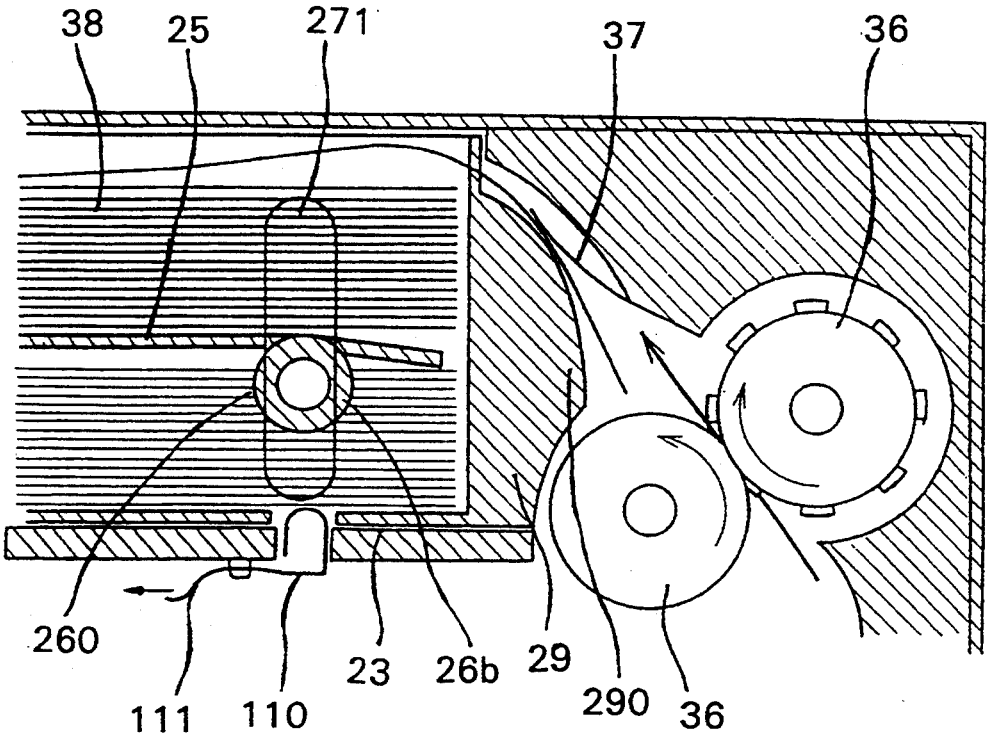
FIGS. 22A and 22B are diagrams for explaining the action of the rear end portion of the hopper.
Figure 22B:
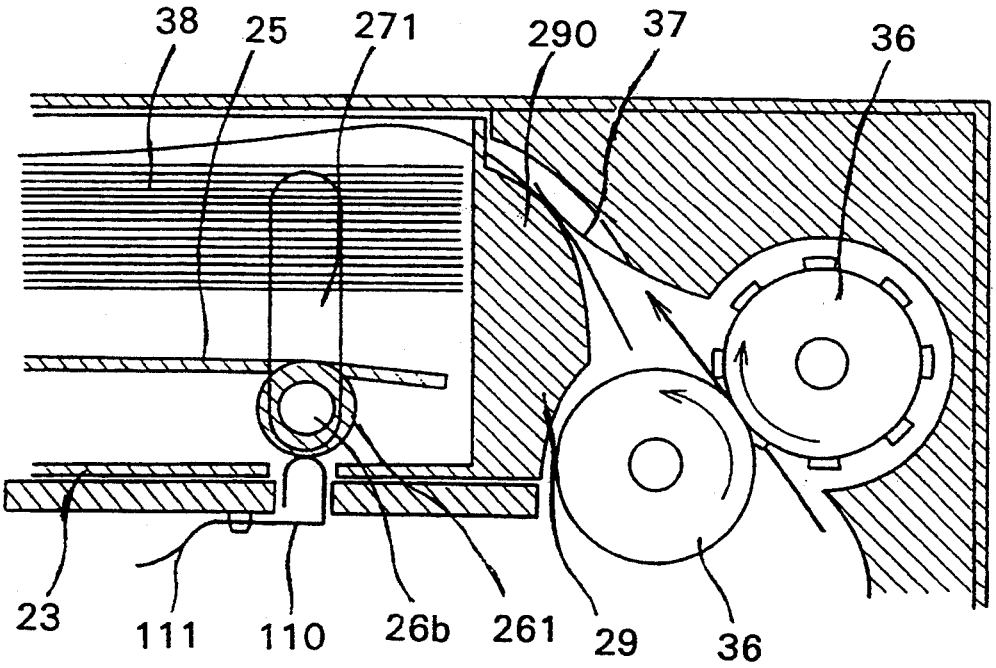

A detailed description will now be given of the hopper 2a of the printing apparatus shown in FIG. 16. FIG. 19 is a perspective view of the hopper shown in FIG. 16, FIG. 20 is a perspective view showing the hopper in FIG. 19 mounted in the printing apparatus, FIGS. 21A and 21B are diagrams for explaining the action of the front end portion of the hopper, and FIGS. 22A and 22B are diagrams for explaining the action of the rear end portion of the hopper.

As shown in FIG. 19, the hopper 2a is formed of a box with no top. More specifically, the hopper 2a has a bottom plate 23, a pair of side plates 27 provided on both sides, a front plate 28 provided at the front side, and a back plate 29 provided at the back side. This bottom plate 23 is provided at the rear side of the bottom of the hopper 2a for supporting unprinted sheets. An opening 23a is provided in the front side of the bottom of the hopper 2a. The feed roller 30 provided on the apparatus side enters the opening 23a to ensure sheet feeding when the hopper 2a is mounted in the apparatus.

A U-shaped guide groove 270 is formed in the front side of each of the side plate pair 27, and an elongated guide groove 271 is formed in the back side thereof. When guide rods 26a and fitting shafts 26b (to be described later) of the partition plate 25 are fitted in those guide grooves 270 and 271, the partition plate 25 is guided up and down in the hopper 2a along the guide grooves 270 and 271. A view window 28a for allowing an operator to check the state of contained sheets from the outside is formed in the front plate 28.

The partition plate 25 is made of a flat plate as illustrated. A pair of guide rods 26a are provided at the front portion of the partition plate 25. The guide rods 26a are fitted to the U-shaped guide grooves 270 of the side plates 27. A pair of fitting shafts 26a are provided at the back portion of the partition plate 25. The fitting shafts 26b are fitted to the guide grooves 271 of the side plates 27.

Therefore, the partition plate 25 can be moved up and down in the hopper 2a while being guided by the sides of the hopper 2a. As the fitting shafts 26b are fitted in the guide grooves 271 of the side plates 27 and the U-shaped guide grooves 270 to which the guide rods 26a are to be engaged each have an open top, the partition plate 25 on the side the guide rods 26a can be lifted upward and swung around the fitting shafts 26b. Accordingly, the space for retaining unprinted sheets below the partition plate 25 can be set free, facilitating the setting of unprinted sheets.

As shown in FIG. 20, this hopper 2a can be mounted as a cassette into the printing apparatus 1 from the front of the apparatus 1. The hopper 2a can also be removed from the front of the apparatus 1. In this diagram, a ready lamp 100, a toner empty lamp 101 and a sheet empty lamp 102 are provided at the front of the printing apparatus 1.

The action of the hopper 2a will now be described referring to FIGS. 21A, 21B, 22A and 22B. FIGS. 21A and 21B illustrate the state of the sheet feeding side of the hopper 2a, while FIGS. 22A and 22B illustrate the state of the discharged-sheet receiving side of the hopper 2a.

In FIG. 21A, a leaf spring 22 is attached to the partition plate 25 to press unprinted sheets in the unprinted-sheet retaining space below the partition plate 25 against a pickup roller 30. FIG. 21A illustrates a maximum number of unprinted sheets set under the partition plate 25 in the hopper 2a. Under this condition, the partition plate 25 is positioned at the upper portion of the hopper 2a, and the leaf spring 22 of the partition plate 25 presses the sheets in the hopper 2a against the pickup roller 30, making the sheet pickup by the pickup roller 30 surer.

As the hopper 2a is inserted and mounted in the apparatus 1 from the right-hand side in the diagram, the hopper 2a is designed so that the bottom plate 23 comes above the pickup roller 30 located inside the apparatus 1. The sheet abutting face at the leading end of the hopper 2a is formed steep so that the pickup roller 30 can pick up sheets. As the sheets under the partition plate 25 of the hopper 2a are fed out by the pickup roller 30, the partition plate 25 moved downward, creating space above this plate 25 in the hopper 2a. In this example, this space is used as a stacker for the discharged sheets. In other words, printed sheets are retained in this space as shown in FIG. 21B.

In FIG. 22A, a guide member 290 for guiding a sheet coming along the feeding path 35 is provided at the back plate 29 of the hopper 2a. A film 37 for pressing a sheet against the guide member 290 is provided on the apparatus side at a position facing this guide member 290.

Further, a sheet empty detecting mechanism is provided on the apparatus side. This sheet empty detecting mechanism is accomplished by using the fitting shafts 26b of the partition plate 25 of the hopper 2a. More specifically, the fitting shafts 26b are each made of a conductive shaft, and a pair of electrodes 110 each made of a leaf spring are provided on the apparatus side. The electrodes 110 are located apart from the fitting shafts 26b in the axial direction at the positions respectively facing both free ends of the fitting shafts 26b. One of the electrode pair 110 is applied with a voltage of several volts (e.g., 5 V) through a lead wire 111.

When there are unprinted sheets below the partition plate 25 in the hopper 2a as shown in FIG. 22A, each electrode 110 is in contact with the lowermost sheet and is thus insulated. When there are no unprinted sheets below the partition plate 25 in the hopper 2a as shown in FIG. 22B, each electrode 110 is electrically connected to the associated fitting shaft 26b which is a conductive shaft. Accordingly, the voltage of one electrode 110 is led to the other electrode 110, so that the sheet empty state can be detected by the voltage on the other electrode 110. When the sheet empty state is detected, the control circuit (not shown) of the printing apparatus stops the printing process and lights the sheet empty lamp 102 shown in FIG. 20. This can prevent the unnecessary action of the pickup roller 30 and the image forming action of the photosensitive drum 10.

The action of the hopper 2a will now be described. A printed sheet is carried along the discharge path 35 to be supplied into the hopper 2a in the direction of the arrow in FIG. 22A by the discharge roller 36. At this time, the leading edge of the sheet is sent on the partition plate 25 in the hopper 2a along a sheet inserting path defined by the apparatus and the back plate 29 of the hopper 2a. Then, the moment the trailing edge of the sheet leaves the discharge roller 36, the movement of the sheet is stopped. To prevent the trailing edge of this sheet from contacting the leading edge of the next sheet to be discharged, thus causing sheet jamming, the trailing edge of the sheet is pressed against the back plate 29 of the hopper 2a by the film 33 provided on the apparatus side. Therefore, a feeding path is formed again between the trailing edge of the sheet and the guide on the apparatus side. The front sheet is fed to be placed on the partition plate 25 of the hopper 2a as the leading edge of the next sheet comes in contact with that front sheet in the hopper 2a.

Printed sheets are collected on the top of the partition plate 25 of the hopper 2a in this manner. When one of the unprinted sheets below the partition plate 25 is fed out, the printed-sheet retaining space above the partition plate 25 becomes free by one sheet. As the sheets are fed out, the printed sheets can be retained. As the printed-sheet retaining space becomes free by the number of unprinted sheets which are fed out, the free printed-sheet retaining space is always the same. Accordingly, the printed sheets can smoothly be retained in the hopper 2a.

As described above, the moment the trailing edge of the sheet leaves the discharge roller 36, the movement of the sheet is stopped. The trailing edge of the sheet therefore protrudes rearward from the hopper 2a. If the hopper 2a is pulled out under this condition to remove the printed sheets, the printed sheets can be taken out without being pulled toward the apparatus as the trailing edges of the sheets remain at the guide member 290 of the back plate 29 of the hopper 2a.

Printed sheets can be retained using the free space in the hopper 2a that is created by the sheet feeding. This design can reduce the height of the apparatus by the height of the otherwise necessary stacker and allows the hopper 2a to also serve as a stacker, thus contributing to making the apparatus slim.

As the hopper 2a is designed to be detachable from the side of the printing apparatus, a computer, a display or the like can be placed on the top of the apparatus.

As the movable partition member 25 is provided in the hopper 2a to separate unprinted sheets from printed sheets, those sheets will not be mixed in the hopper 2a. Further, as the unprinted sheets are fed out, the space for retaining the printed sheets increases, thus ensuring smooth sheet collection. As this partition member 25 is provided with the spring member 22 for pressing unprinted sheets against the pickup roller 30, this partition member can press the unprinted sheets against pickup roller 30, thus ensuring stable sheet feeding. Furthermore, the partition member 25 can be removed from the hopper 2a, facilitating the setting of unprinted sheets.

As the hopper 2a is designed as a cassette, it can be removed from the apparatus to set sheets inside or remove the printed sheets. As the guide portion 290 for discharged sheets is provided at the rear end portion 29 of the hopper 2a, it is possible to prevent the sheets from being pulled by the guides on the apparatus side so that the sheets cannot be taken out at the time the hopper 2a is detached.

The present invention is not limited to the above embodiment, but may be modified in various manners as follows. First, although the present invention has been explained as a printing apparatus, it may be a different type of image forming apparatus, such as a copying machine or facsimile. Secondly, although the print; process unit 1 has been explained as an electrophotographying mechanism in the foregoing description of the embodiments, another printing mechanism which transfers a toner image may also be used, and sheets are not limited to paper but other types of media can also be used. Thirdly, although the photosensitive drum 10 is not limited to a drum type, but may be of an endless belt type. Fourthly, the charging means is not limited to a transfer roller, but may be an endless transfer belt or a transfer charger. Fifthly, although the optical unit has been explained as an EL (electroluminescent) optical system, the optical unit can be accomplished by a laser optical system, a LED optical system, a liquid crystal shutter optical system or the like. Sixthly, although the developing unit has been explained to use a non-magnetic, one-component developer in the foregoing description, it may use another known method, such as two-component magnetic brush development or magnetic toner development. Seventhly, the apparatus may be placed upright using stands or the like to improve the stability. Eighthly, although the hopper 2a is designed to be attachable and detachable from the side, it may be attached and detached from the above. Further, the hopper need not take the form of a cassette and may be fixed to the apparatus.

In short, according to this invention, the feeding path has a U shape, a hopper is provided on one side of the U-shaped feeding path, and a print process unit is disposed between the two sides of the U-shaped feeding path so that the print process unit transfer a toner image on a sheet at the opposite side of the U-shaped feeding path. Therefore, the size of the apparatus can be reduced to the side of sheets and the apparatus can be designed as tall as the print process unit. This design can accomplish a compact and slim printer. The printing apparatus can be placed upright, thus contributing to the reduction of the space for the apparatus on a desk or the like so that the space on the desk can be used effectively.

Further, since a discharge path for discharging printed sheets in the hopper is provided to permit the hopper to be used as a stacker, the apparatus can be made shorter by the otherwise necessary separate stacker, and unused space of the space can effectively be used, thus contributing to making the apparatus slim. As no separate stacker is necessary, the number of components can be reduced, thus contributing to the cost reduction.

What is claimed is:

1. A printing apparatus comprising:

a hopper for retaining sheets;

a feeding path defined on that surface of the apparatus which is opposite to that surface of the apparatus where the hopper is disposed for conveyance of sheets, said hopper being provided above the feeding path;

a feeding mechanism for feeding a sheet from the hopper onto the feeding path;

an endless rotary latent image carrier provided between the hopper and the feeding path;

an image forming unit, provided between the hopper and the feeding path, for forming a toner image on the latent image carrier;

a transfer unit for transferring the toner image on the latent image carrier onto the sheet conveyed along the feeding path;

a fixing unit for fixing the toner image on the sheet and a discharge path for discharging a sheet having the toner image fixed by the fixing unit, to a top portion of the hopper.

2. The printing apparatus according to claim 1, wherein the hopper has a bottom plate for supporting the retained sheets and an openable and closable cover for covering the retained sheets; and the discharge path allows the sheets to be discharged on the cover.

3. The printing apparatus according to claim 2, further having an openable and closable cover provided above the cover of the hopper.

4. The printing apparatus according to claim 1, wherein the hopper has a bottom plate for supporting the retained sheets, an openable and closable cover for covering the retained sheets, an opening for exposing a lowermost one of the retained sheets, and a pressing member, provided on the cover, for pressing the lowermost sheet above the opening; and the feeding mechanism comprises a feed roller which comes in contact with said lowermost sheet at the opening of the hopper to feed out that sheet.

5. The printing apparatus according to claim 1, further comprising a discharge path for discharging a sheet having the toner image fixed by the fixing unit, into the hopper.

6. The printing apparatus according to claim 1, further comprising a partition member provided in the hopper for separating those sheets to be fed out from the discharged sheet.

7. The printing apparatus according to claim 6, wherein the hopper has a bottom plate for supporting the retained sheets, a pair of side plates, a front plate, and a back plate, with guide grooves formed in the side plates; and the partition member has guide rods to be fitted in the guide grooves so that the partition member is movable along the side plates.

8. The printing apparatus according to claim 6, wherein the hopper has a bottom plate for supporting the retained sheets, a pair of side plates, a front plate, a back plate, an opening for exposing a lowermost one of the retained sheets, and a pressing member, provided on the partition member, for pressing the lowermost sheet above the opening; and the feeding mechanism comprises a feed roller which comes in contact with said lowermost sheet at the opening of the hopper to feed out that sheet.

9. The printing apparatus according to claim 5, wherein a guide member for the discharged sheet is provided at a rear end portion of the hopper.

10. The printing apparatus according to claim 1, wherein the hopper is a cassette attachable and detachable to and from the apparatus.

11. The printing apparatus according to claim 1, wherein the hopper is provided below the feeding path.

12. The printing apparatus according to claim 1, wherein the hopper has a bottom plate for supporting the retained sheets, an openable and closable cover for covering the retained sheets, an opening for exposing a lowermost one of the retained sheets, and a pressing member, provided on the cover, for pressing the lowermost sheet above the opening; and the feeding mechanism comprises a feed roller which comes in contact with said lowermost sheet at the opening of the hopper to feed out that sheet.

13. The printing apparatus according to claim 1, further comprising a discharge path for discharging a sheet having the toner image fixed by the fixing unit, into the hopper.

14. A printing apparatus comprising:

a hopper for retaining sheets;

a feeding path defined on that surface of the apparatus which is opposite to that surface of the apparatus where the hopper is disposed for conveyance of sheets, said hopper being provided above the feeding path;

a feeding mechanism for feeding a sheet from the hopper onto the feeding path;

an endless rotary latent image carrier provided between the hopper and the feeding path;

an image forming unit, provided between the hopper and the feeding path, for forming a toner image on the latent image carrier;

a transfer unit for transferring the toner image on the latent image carrier onto the sheet conveyed along the feeding path;

a fixing unit for fixing the toner image on the sheet;

said image forming unit comprising an electrostatic latent imaging forming unit, provided at one side of the latent image carrier, for forming an electrostatic latent image on the latent image carrier;

a developing unit, provided on the other side of the latent image carrier, for developing the electrostatic latent image on the latent image carrier; said hopper being provided above the feeding path; and a discharge path for discharging a sheet having the toner image fixed by the fixing unit, to a top portion of the hopper.

15. The printing apparatus according to claim 14, wherein the hopper has a bottom plate for supporting the retained sheets and an openable and closable cover for covering the retained sheets; and the discharge path allows the sheets to be discharged on the cover.

16. The printing apparatus according to claim 15, further having an openable and closable cover provided above the cover of the hopper.

17. The printing apparatus according to claim 13, further comprising a partition member provided in the hopper for separating those sheets to be fed out from the discharged sheet.

18. The printing apparatus according to claim 17, wherein the hopper has a bottom plate for supporting the retained sheets, a pair of side plates, a front plate, and a back plate, with guide grooves formed in the side plates; and the partition member has guide rods to be fitted in the guide grooves so that the partition member is movable along the side plates.

19. The printing apparatus according to claim 17, wherein the hopper has a bottom plate for supporting the retained sheets, a pair of side plates, a front plate, a back plate, an opening for exposing a lowermost one of the retained sheets, and a pressing member, provided on the partition member, for pressing the lowermost sheet above the opening; and the feeding mechanism comprises a feed roller which comes in contact with said lowermost sheet at the opening of the hopper to feed out that sheet.

20. The printing apparatus according to claim 13, wherein a guide member for the discharged sheet is provided at a rear end portion of the hopper.

21. The printing apparatus according to claim 13, wherein the latent image carrier and the image forming unit are provided between the feeding path and the hopper and on the sheet discharging side.

22. A printing apparatus comprising:

a hopper for retaining sheets, said hopper having a bottom plate;

a frame for supporting a guide member guiding the sheet and forming a feeding path of the sheet, the feeding path formed by the guide member being in parallel with and spaced apart from the bottom plate said hopper provided above the feeding path;

a feeding mechanism for feeding a sheet from the hopper to the feeding path;

an endless latent image carrier provided between the hopper and the feeding path;

an image forming unit, provided between the hopper and the feeding path, for forming a toner image on the latent image carrier;

a transfer unit for transferring the toner image on the latent image carrier onto the sheet conveyed along the feeding path;

a fixing unit for fixing the toner image on the sheet; and a discharge path for discharging a sheet having the toner image fixed by the fixing unit, to a top portion of the hopper.

23. A printing apparatus comprising:

a hopper for retaining sheets, said hopper including a bottom plate, the bottom plate having a front end portion from which the sheet is fed out and a rear end portion;

a frame for supporting a guide member guiding the sheet and forming a feeding path of the sheet, the feeding path formed by the guide member being in parallel with and spaced apart from the bottom plate, the outside of said frame being of a box shape, the cross section of the box shape frame being rectangular having two surfaces being parallel with each other, the parallel surfaces being in parallel with the guide member and the bottom plate, and one corner of said box shape frame located near the rear end portion of the bottom plate;

a feeding mechanism for feeding a sheet from said hopper onto the feeding path;

an endless image carrier provided between said hopper and the feeding path;

an image forming unit, provided between said hopper and the feeding path, for forming a toner image on said latent image carrier;

a transfer unit for transferring the toner image on said latent image carrier onto the sheet conveyed along the feeding path;

a fixing unit for fixing the toner image on the sheet; and a discharge path for discharging a sheet having the toner image fixed by the fixing unit, from the corner of said frame toward the outside of said box shape frame.

24. The printing apparatus according to claim 23, wherein the feeding mechanism is a feed roller for feeding sheets in the hopper onto the feeding path.

25. The printing apparatus according to claim 23, wherein the hopper is provided above the feeding path.

26. The printing apparatus according to claim 25, wherein said discharge path for discharging a sheet having the toner image fixed by the fixing unit discharges to a top portion of the hopper.

27. The printing apparatus according to claim 26, wherein the hopper includes an openable and closable cover for covering the retained sheets; and the discharge path allows the sheets to be discharged on the cover.

28. The printing apparatus according to claim 27, further having an openable and closable cover provided above the cover of the hopper.

29. The printing apparatus according to claim 23, wherein the hopper has an openable and closable cover for covering the retained sheets, an opening for exposing a lowermost one of the retained sheets, and a pressing member, provided on the cover, for pressing the lowermost sheet above the opening; and the feeding mechanism comprises a feed roller which comes in contact with said lowermost sheet at the opening of the hopper to feed out that sheet.

30. The printing apparatus according to claim 23, wherein the discharge path for discharging a sheet having the toner image fixed by tile fixing unit is into the hopper.

31. The printing apparatus according to claim 23, further comprising a partition member provided in the hopper for separating those sheets to be fed out from the discharged sheet.

32. The printing apparatus according to claim 31, wherein the hopper has a pair of side plates, a front plate, and a back plate, with guide grooves formed in the side plates; and the partition member has guide rods to be fitted in the guide grooves so that the partition member is movable along the side plates.

33. The printing apparatus according to claim 31, wherein the hopper has a pair of side plates, a front plate, a back plate, an opening for exposing a lowermost one of the retained sheets, and a pressing member, provided on the partition member, for pressing the lowermost sheet above the opening; and the feeding mechanism comprises a feed roller which comes in contact with said lowermost sheet at the opening of the hopper to feed out that sheet.

34. The printing apparatus according to claim 30, wherein a guide member for the discharged sheet-is provided at a rear end portion of the hopper.

35. The printing apparatus according to claim 23, wherein the image forming unit comprises an electrostatic latent image forming unit, provided on one side of the latent image carrier, for forming an electrostatic latent image on the latent image carrier, and a developing unit, provided on the other side of the latent image carrier, for developing the electrostatic latent image on the latent image carrier.

36. The printing apparatus according to claim 35, wherein the hopper is provided above the feeding path.

37. The printing apparatus according to claim 36, further comprising a discharge path for discharging a sheet having the toner image fixed by the fixing unit, to a top portion of the hopper.

38. The printing apparatus according to claim 37, wherein the hopper has a bottom plate for supporting the retained sheets and an openable an closable cover for covering the retained sheets; and the discharge path allows the sheets to be discharged on the cover.

39. The printing apparatus according to claim 38, further having an openable and closable cover provided above the cover of the hopper.

40. The printing apparatus according to claim 35, wherein the hopper has an openable and closable cover for covering the retained sheets, an opening for exposing a lowermost one of the retained sheets, and a pressing member, provided in the cover, for pressing the lowermost sheet above the opening; and the feeding mechanism comprises a feed roller which comes in contact with said lowermost sheet at the opening of the hopper to feed out that sheet.

41. The printing apparatus according to claim 35, further comprising a discharge path for discharging a sheet having the toner image fixed by the fixing unit, into the hopper.

42. The printing apparatus according to claim 41, further comprising a partition member provided in the hopper for separating those sheets to be fed out from the discharged sheet.

43. The printing apparatus according to claim 42, wherein the hopper has a pair of side plates, a front plate, and a back plate, with guide grooves formed in the side plates; and the partition member has guide rods to be fitted in the guide grooves so that the partition member is movable along the side plates.

44. The printing apparatus according to claim 42, wherein the hopper has a pair of side plates, a front plate, a back plate, an opening for exposing a lowermost one of the retained sheets, and a pressing member, provided on the partition member, for pressing the lowermost sheet above the opening; and the feeding mechanism comprises a feed roller which comes in contact with said lowermost sheet at the opening of the hopper to feed out that sheet.

45. The printing apparatus according to claim 41, wherein a guide member for the discharge sheet is provided at a rear end portion of the hopper.

46. The printing apparatus according to claim 41, wherein the latent image carrier and the image forming unit are provided between the feeding path and the hopper and on the sheet discharging side.

47. The printing apparatus according to claim 23, wherein the hopper is a cassette attachable and detachable to and from the apparatus.

48. The printing apparatus according to claim 23, wherein the hopper is provided below the feeding path.

49. A printing apparatus comprising:

a hopper for retaining sheets, said hopper including a bottom plate, the bottom plate having a front end portion from which the sheet is fed out and a rear end portion;

a frame for supporting a guide member guiding the sheet and forming a feeding path of the sheet, the feeding path formed by the guide member being in parallel with and spaced apart from the bottom plate, said frame being rectangular in shape and having a corner formed near the rear end portion of the bottom plate;

a feeding mechanism for feeding a sheet from said hopper onto the feeding path;

an endless latent image carrier provided between said hopper and the feeding path;

an image forming unit, provided between said hopper and the feeding path, for forming a toner image on said latent image carrier;

a transfer unit for transferring the toner image on said latent image carrier onto the sheet conveyed along the feeding path;

a fixing unit for fixing the toner image on the sheet;

a discharge path for discharging a sheet having the toner image fixed by the fixing unit, to the corner of said frame;

wherein the feeding mechanism is a feed roller for feeding sheets in the hopper onto the feeding path;

wherein the hopper is provided above the feeding path; and wherein said discharge path for discharging a sheet having the toner image fixed by the fixing unit discharges to a top portion of the hopper.

50. The printing apparatus according to claim 49, wherein the hopper includes an openable and closable cover for covering the retained sheets; and the discharge path allows the sheets to be discharged on the cover.

51. The printing apparatus according to claim 50, further having an openable and closable cover provided above the cover of the hopper.

52. The printing apparatus according to claim 49, wherein the hopper has an openable and closable cover for covering the retained sheets, an opening for exposing a lowermost one of the retained sheets, and a pressing member, provided on the cover, for pressing the lowermost sheet above the opening; and the feeding mechanism comprises a feed roller which comes in contact with said lowermost sheet at the opening of the hopper to feed out that sheet.

53. The printing apparatus according to claim 49, wherein the discharge path for discharging a sheet having the toner image fixed by the fixing unit is into the hopper.

54. The printing apparatus according to claim 49, further comprising a partition member provided in the hopper for separating those sheets to be fed out from the discharged sheet.

55. The printing apparatus according to claim 54, wherein the hopper has a pair of side plates, a front plate, and a back plate, with guide grooves formed in the side plates; and the partition member has guide rods to be fitted in the guide grooves so that the partition member is movable along the side plates.

56. The printing apparatus according to claim 54, wherein the hopper has a pair of side plates, a front plate, a back plate, an opening for exposing a lowermost one of the retained sheets, and a pressing member, provided on the partition member, for pressing the lowermost sheet above the opening; and the feeding mechanism comprises a feed roller which comes in contact with said lowermost sheet at the opening of the hopper to feed out that sheet.

57. The printing apparatus according to claim 53, wherein a guide member for the discharged sheet is provided at a rear end portion of the hopper.

58. The printing apparatus according to claim 49, wherein the hopper is a cassette attachable and detachable to and from the apparatus.

59. The printing apparatus according to claim 49, wherein the hopper is provided below the feeding path.

60. A printing apparatus comprising:

a hopper for retaining sheets, said hopper including a bottom plate, the bottom plate having a front end portion from which the sheet is fed out and a rear end portion;

a frame for supporting a guide member guiding the sheet and forming a feeding path of the sheet, the feeding path formed by the guide member being in parallel with and spaced apart from the bottom plate, said frame being rectangular in shape and having a corner formed near the rear end portion of the bottom plate;

a feeding mechanism for feeding a sheet from said hopper onto the feeding path;

an endless image carrier provided between said hopper and the feeding path;

an image forming unit, provided between said hopper and the feeding path, for forming a toner image on said latent image carrier;

a transfer unit for transferring the toner image on said latent image carrier onto the sheet conveyed along the feeding path;

a fixing unit for fixing the toner image on the sheet;

a discharge path for discharging a sheet having the toner image fixed by the fixing unit, to the corner of said frame;

wherein the image forming unit comprises an electrostatic latent image forming unit, provided on one side of the latent image carrier, for forming an electrostatic latent image on the latent image carrier, and a developing unit, provided on the other side of the latent image carrier, for developing the electrostatic latent image on the latent image carrier; and wherein the hopper is provided above the feeding path.

61. The printing apparatus according to claim 60, further comprising a discharge path for discharging a sheet having the toner image fixed by the fixing unit, to a top portion of the hopper.

62. The printing apparatus according to claim 60, wherein the hopper has a bottom plate for supporting the retained sheets and an openable and closable cover for covering the retained sheets; and the discharge path allows the sheets to be discharged on the cover.

63. The printing apparatus according to claim 62, further having an openable and closable cover provided above the cover of the hopper.

64. The printing apparatus according to claim 61, wherein the hopper has an openable and closable cover for covering the retained sheets, an opening for exposing a lowermost one of the retained sheets, and a pressing member, provided in the cover, for pressing the lowermost sheet above the opening; and the feeding mechanism comprises a feed roller which comes in contact with said lowermost sheet at the opening of the hopper to feed out that sheet.

65. The printing apparatus according to claim 60, further comprising a discharge path for discharging a sheet having the toner image fixed by the fixing unit, into the hopper.

66. The printing apparatus according to claim 65, further comprising a partition member provided in the hopper for separating those sheets to be fed out from the discharged sheet.

67. The printing apparatus according to claim 66, wherein the hopper has a pair of side plates a front plate, and a back plate, with guide grooves formed in the side plates; and the partition member has guide rods to be fitted in the guide grooves so that the partition member is movable along the side plates.

68. The printing apparatus according to claim 66, wherein the hopper has a pair of side plates, a front plate a back plate, an opening for exposing a lowermost one of the retained sheets, and a pressing member provided on the partition member, for pressing the lowermost sheet above the opening; and the feeding mechanism comprises a feed roller which comes in contact with said lowermost sheet at the opening of the hopper to feed out that sheet.

69. The printing apparatus according to claim 65, wherein a guide member for the discharge sheet is provided at a rear end portion of the hopper.

70. The printing apparatus according to claim 65, wherein the latent image carrier and the image forming unit are provided between the feeding path and the hopper and on the sheet discharging side.

* * * * *